US011036154B2

(12) United States Patent
Ukigaya et al.

(10) Patent No.: US 11,036,154 B2
(45) Date of Patent: Jun. 15, 2021

(54) TONER, TONER STORAGE UNIT, IMAGE FORMING APPARATUS, AND IMAGE FORMING METHOD

(71) Applicants: Masayuki Ukigaya, Shizuoka (JP); Junichi Awamura, Shizuoka (JP); Hiroshi Yamada, Shizuoka (JP); Kohsuke Nagata, Chiba (JP); Hiroyuki Takeda, Kanagawa (JP)

(72) Inventors: Masayuki Ukigaya, Shizuoka (JP); Junichi Awamura, Shizuoka (JP); Hiroshi Yamada, Shizuoka (JP); Kohsuke Nagata, Chiba (JP); Hiroyuki Takeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/199,321

(22) Filed: Nov. 26, 2018

(65) Prior Publication Data

US 2019/0171122 A1 Jun. 6, 2019

(30) Foreign Application Priority Data

Dec. 5, 2017 (JP) ..... JP2017-233456
Sep. 19, 2018 (JP) ..... JP2018-174811

(51) Int. Cl.
*G03G 9/087* (2006.01)
*G03G 15/08* (2006.01)

(52) U.S. Cl.
CPC ..... *G03G 9/08755* (2013.01); *G03G 9/08764* (2013.01); *G03G 9/08795* (2013.01); *G03G 9/08797* (2013.01); *G03G 15/0865* (2013.01)

(58) Field of Classification Search
CPC ..... G03G 9/08764; G03G 9/08755; G03G 9/08797
See application file for complete search history.

(56) References Cited

U.S. PATENT DOCUMENTS 5,296,546 A 3/1994 Kishida et al.
2013/0157193 A1* 6/2013 Moritani ..... G03G 9/08728 430/109.4
2013/0216944 A1* 8/2013 Shiba ..... G03G 9/0819 430/105
2014/0080046 A1 3/2014 Asahina et al.
2014/0080047 A1 3/2014 Takahashi et al.
2015/0024312 A1 1/2015 Shiba et al.
(Continued)

FOREIGN PATENT DOCUMENTS

EP 0 256 136 A1 2/1988
JP 63-109447 5/1988
(Continued)

*Primary Examiner* — Peter L Vajda
(74) *Attorney, Agent, or Firm* — Oblon, McClelland, Maier & Neustadt, L.L.P.

(57) ABSTRACT

A toner is provided. The toner comprises a colorant, a release agent, and a binder resin. The binder resin comprises a crystalline polyester resin and an amorphous polyester resin. The amorphous polyester resin comprises an amorphous polyester resin A and an amorphous polyester resin B. The amorphous polyester resin A comprises an isocyanurate backbone and at least one of urethane bond and urea bond. The amorphous polyester resin B comprises a trimellitic acid backbone and at least one of urethane bond and urea bond.

8 Claims, 7 Drawing Sheets

(56) References Cited

U.S. PATENT DOCUMENTS

| | | | |
|---|---|---|---|
| 2017/0363980 | A1 | 12/2017 | Nagata et al. |
| 2017/0371257 | A1 | 12/2017 | Santo et al. |
| 2018/0024452 | A1 | 1/2018 | Sugimoto et al. |

FOREIGN PATENT DOCUMENTS

| | | | | |
|---|---|---|---|---|
| JP | 9-281746 | | 10/1997 | |
| JP | 11-133665 | | 5/1999 | |
| JP | 2001-158819 | | 6/2001 | |
| JP | 2002-287400 | | 10/2002 | |
| JP | 2002-351143 | | 12/2002 | |
| JP | 2004-046095 | | 2/2004 | |
| JP | 2007-271789 | | 10/2007 | |
| JP | 2013-054178 | | 3/2013 | |
| JP | 2013-145369 | | 7/2013 | |
| JP | 2017-058650 | | 3/2017 | |
| WO | WO 2016/067531 | * | 5/2016 | ..... G03G 9/087 |

* cited by examiner

TONER, TONER STORAGE UNIT, IMAGE FORMING APPARATUS, AND IMAGE FORMING METHOD

CROSS-REFERENCE TO RELATED APPLICATIONS

This patent application is based on and claims priority pursuant to 35 U.S.C. § 119(a) to Japanese Patent Applications No. 2017-233456 and 2018-174811, filed on Dec. 5, 2017 and Sep. 19, 2018 in the Japan Patent Office, the entire disclosure of each of which is hereby incorporated by reference herein.

BACKGROUND

Technical Field

The present disclosure relates to a toner, a toner storage unit, an image forming apparatus, and an image forming method.

Description of the Related Art

In recent years, toner has been required to have a small particle size for higher image quality, high-temperature offset resistance, low-temperature fixability for energy saving, and heat-resistant storage stability to be resistant to high temperature and high humidity during storage or transportation after manufacture. Since most of the power during an image forming process is used for fixing toner on a recording medium, it is effective to improve low-temperature fixability in terms of energy saving.

Conventionally, toners produced by kneading and pulverization processes ("pulverization toners") have been widely used. However, pulverization toners have some drawbacks. Firstly, it is difficult to produce pulverization toners having a small particle size. Secondly, the output image quality is insufficient because the shape is irregular and the particle size distribution is broad. Thirdly, a high fixing energy is required. In a case in which a pulverization toner includes a wax (release agent) for improving fixability, the wax is exposed in large amounts at the surface of the toner, because the kneaded mixture of raw materials cracks at the interface between the wax and other materials in the pulverization process. The exposed wax exerts a releasing effect. At the same time, disadvantageously, the exposed wax is likely to adhere to carrier particles, photoconductors, and/or blades (this phenomenon may be hereinafter referred to as "filming"). Thus, it is said that total performance of pulverization toners is insufficient.

In attempting to overcome such drawbacks of pulverization toners, toners produced by polymerization processes (hereinafter "polymerization toners") have been proposed. It is generally easy for polymerization processes to produce a toner having a smaller particle size and a narrower particle size distribution compared to pulverization processes, and furthermore, to encapsulate a release agent in the toner.

However, the proposed polymerization toners do not satisfy the high level of low-temperature fixability demanded in recent years.

For further improving low-temperature fixability, various toners have been proposed which contain a crystalline resin. However, the proposed toners do not satisfy the high level of low-temperature fixability demanded in recent years.

In addition, for the purpose of improving heat-resistant storage stability of toner, there have been attempts to lower the glass transition temperature of the toner.

However, the proposed toners do not satisfy the high level of low-temperature fixability demanded in recent years.

There is a need for a toner having excellent low-temperature fixability, high gloss, and heat-resistant storage stability.

SUMMARY

In accordance with some embodiments of the present invention, a toner is provided. The toner comprises a colorant, a release agent, and a binder resin. The binder resin comprises a crystalline polyester resin and an amorphous polyester resin. The amorphous polyester resin comprises an amorphous polyester resin A and an amorphous polyester resin B. The amorphous polyester resin A comprises an isocyanurate backbone and at least one of urethane bond and urea bond. The amorphous polyester resin B comprises a trimellitic acid backbone and at least one of urethane bond and urea bond.

In accordance with some embodiments of the present invention, a toner storage unit is provided. The toner storage unit includes a container and the above-described toner stored in the container.

In accordance with some embodiments of the present invention, an image forming apparatus is provided. The image forming apparatus includes an electrostatic latent image bearer, an electrostatic latent image forming device, and a developing device. The electrostatic latent image forming device is configured to form an electrostatic latent image on the electrostatic latent image bearer. The developing device contains the above-described toner and is configured to develop the electrostatic latent image formed on the electrostatic latent image bearer with the toner to form a visible image.

In accordance with some embodiments of the present invention, an image forming method includes the processes of charging an electrostatic latent image bearer; forming an electrostatic latent image on the charged electrostatic latent image bearer; developing the electrostatic latent image bearer into a toner image with the above-described toner; primarily transferring the toner image formed on the electrostatic latent image bearer onto an intermediate transfer medium; secondarily transferring the toner image transferred onto the intermediate transfer medium onto a recording medium; fixing the toner image on the intermediate transfer medium by application of heat and pressure; and removing residual toner particles remaining on the electrostatic latent image bearer after the toner image has been transferred onto the intermediate transfer medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
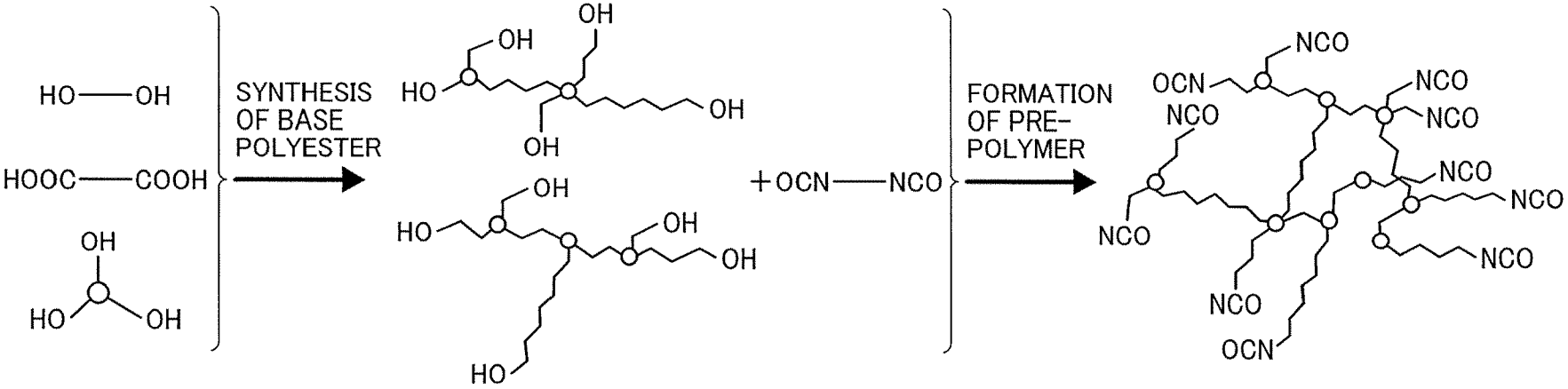
FIG. 1 RELATED ART
FIG. 1 is a scheme for obtaining a conventional polyester resin having a branched structure.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner having excellent low-temperature fixability, gloss, and heat-resistant storage stability is provided.

A toner according to an embodiment of the present invention comprises a colorant, a release agent, and a binder resin. The binder resin comprises a crystalline polyester resin and an amorphous polyester resin. The amorphous polyester resin comprises an amorphous polyester resin A comprising an isocyanurate backbone and at least one of urethane bond and urea bond and an amorphous polyester resin B comprising a trimellitic acid backbone and at least one of urethane bond and urea bond.

One approach for improving low-temperature fixability involves reducing the glass transition temperature or molecular weight of a polyester resin (e.g., an amorphous polyester resin) so that the polyester resin melts together with a crystalline polyester resin. However, merely reducing the glass transition temperature or molecular weight of the polyester resin to reduce melt viscosity may result in deterioration of heat-resistant storage stability and high-temperature offset resistance at the time of fixing of the toner.

On the other hand, the amorphous polyester resin A contained in the toner according to an embodiment of the present invention has a branched structure in its molecular framework due to the presence of urethane and/or urea bonds. Thus, the molecular chain of the amorphous polyester resin A takes a three-dimensional network structure that exhibits rubber-like property being deformable but not flowable at low temperatures. Accordingly, even when the glass transition temperature of the amorphous polyester resin A is extremely reduced, heat-resistant storage stability and high-temperature offset resistance of the toner can be maintained.

In addition, if the network structure is nonuniform, a portion where the network is coarse causes deterioration of heat-resistant storage stability because the resin is insufficiently suppressed from flowing, and a portion where the network is dense causes deterioration of low-temperature fixability and image gloss because deformability of the resin is insufficient.

FIG. 1 is a scheme for obtaining a conventional polyester resin having a branched structure. In a case in which the branched portion of this polyester resin comprises an ester structure and brunched structures are non-uniformly distributed as illustrated in FIG. 1, low-temperature fixability and image gloss are not sufficiently satisfactory.

It is not easy for such a conventional polyester resin to have satisfactory low-temperature fixability, image gloss, heat resistant storage stability, and high-temperature offset resistance at the same time.

On the other hand, the amorphous polyester resin A according to an embodiment of the present invention has a network structure formed by binding the R2 moiety comprising a polyester or a modified polyester to the R1 moiety via urethane or urea group. The network structure can be made more uniform by narrowing the molecular weight distribution of the R2 moiety.

Figure 2:
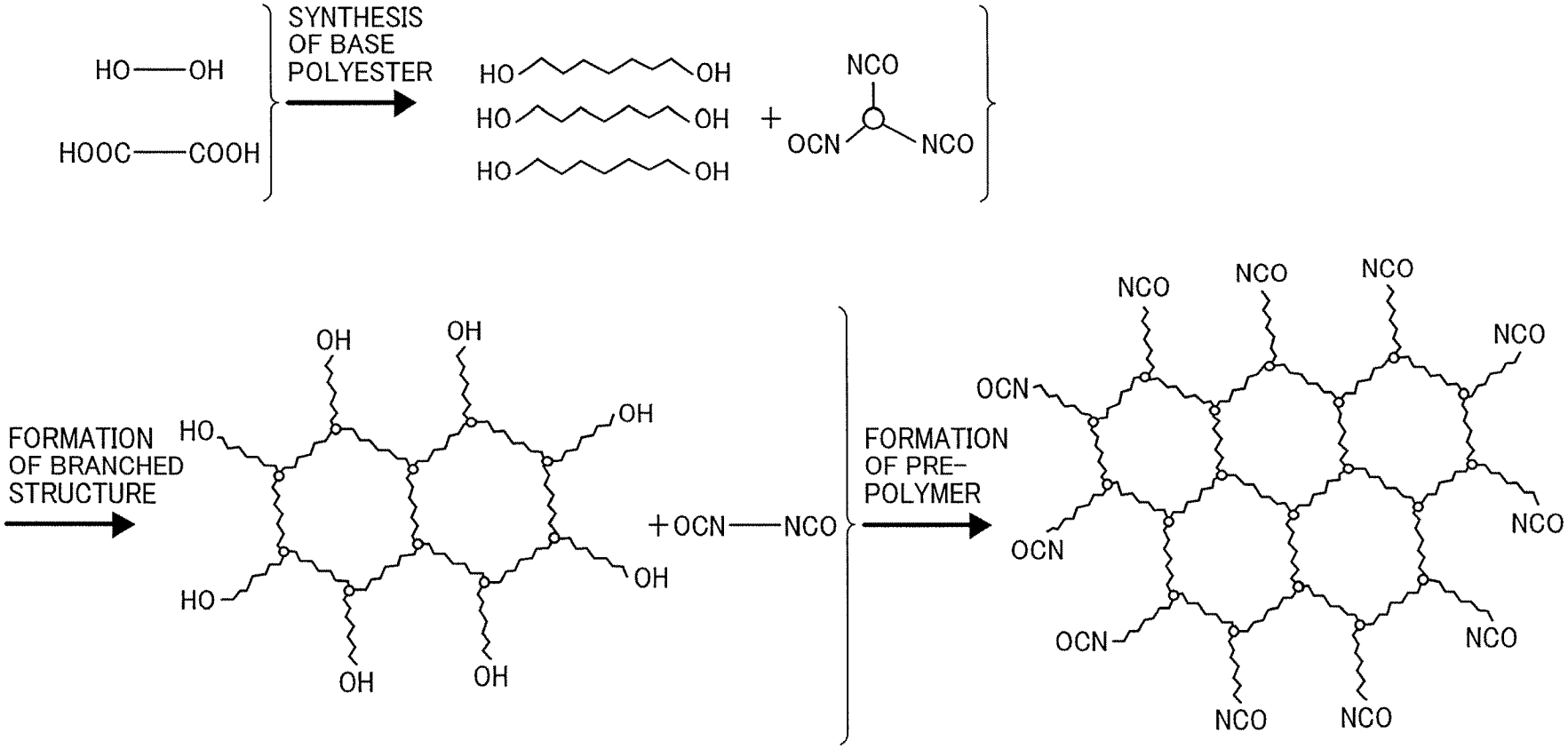
FIG. 2 is a scheme for obtaining the amorphous polyester resin A having a branched structure according to an embodiment of the present invention.

FIG. 2 is a scheme for obtaining the amorphous polyester resin A having a branched structure according to an embodiment of the present invention. The amorphous polyester resin A has a structure as illustrated in FIG. 2. Since the straight-chain polyester portions in the R2 moiety have the same length, as illustrated in FIG. 2, the branched structures in the amorphous polyester resin A are uniformly distributed.

As the network structure in the amorphous polyester resin A is uniform, the toner satisfies all of heat-resistant storage stability, low-temperature fixability, image gloss, and high-temperature offset resistance at the same time.

Furthermore, since the branched portions of the amorphous polyester resin A have urethane or urea bonds having high cohesive energy and behave like strong cross-linking points, even when the network structure is coarse, the resin is strongly suppressed from flowing. Thus, the toner satisfies all of heat-resistant storage stability, low-temperature fixability, image gloss, and high-temperature offset resistance at the same time.

For further improving high-temperature offset resistance and heat-resistant storage stability while maintaining excellent low-temperature fixability, high gloss, and high color reproducibility, the toner according to an embodiment of the present invention contains the amorphous polyester resin A having an ultra low glass transition temperature ("Tg") and the amorphous polyester resin B having a high Tg in combination. The amorphous polyester resin A exhibits excellent low-temperature fixability, high gloss, and high color reproducibility due to its deformability at low temperatures. Furthermore, the amorphous polyester resin B improves high-temperature offset resistance and heat-resistant storage stability due to its high elastic modulus at high temperatures.

Thus, by containing the amorphous polyester resin A and the amorphous polyester resin B having different glass transition temperatures together in the toner, excellent low-temperature fixability, high-temperature offset resistance, high gloss, high color reproducibility, and heat-resistant storage stability are all achieved.

Polyester Resin

Amorphous Polyester Resin A

The amorphous polyester resin A has a structure represented by any one of the following structural formulae 1) to 3), in each of which R2 moiety comprising a polyester or a modified polyester is bound to R1 moiety corresponding to a branched structure via urethane or urea group.

$$R1\text{-}(NHCONH—R2)_n\text{-} \quad 1)$$

$$R1\text{-}(NHCOO—R2)_n\text{-} \quad 2)$$

$$R1\text{-}(OCONH—R2)_n\text{-} \quad 3)$$

In the above formulae, n represents an integer of 3, R1 represents an isocyanurate backbone, and R2 represents a group derived from a polyester comprising a polycarboxylic acid and a polyol or from an isocyanate-modified polyester. The amorphous polyester resin A has at least one of urethane bond and urea bond in the branched structure portion. Such urethane bond and/or urea bond behave as pseudo cross-linking points, thereby enhancing rubbery property of the amorphous polyester resin A and providing a toner having excellent heat-resistant storage stability and high-temperature offset resistance.

The amorphous polyester resin A contains a diol component as a constituent. Preferably, the amorphous polyester resin A further contains a dicarboxylic acid component as a constituent.

The amorphous polyester resin A is not particularly limited as long as the R2 moiety comprising a polyester or a modified polyester is bound to the R1 moiety corresponding to a branched structure via urethane or urea group, and can be selected according to the purpose.

The method of binding the R1 and R2 moieties may be any one of the following methods a) and b), but is not limited thereto.

a) A method in which a diol component and a dicarboxylic acid component undergo esterification reaction to prepare a polyester polyol (R2) having a hydroxyl group on its terminal and the obtained polyester polyol reacts with an isocyanurate (R1).

b) A method in which a diol component and a dicarboxylic acid component undergo esterification reaction to prepare a polyester polyol (R2) having a hydroxyl group on its terminal, the obtained polyester reacts with a divalent polyisocyanate to prepare an isocyanate-modified polyester (R2), and the obtained isocyanate-modified polyester reacts with an isocyanurate (R1) in the presence of pure water.

It is also possible to allow residual hydroxyl group remaining in the polyol obtained by any one of the above methods a) and b) to react with a polyisocyanate having two or more valences to prepare a polyester prepolymer and allow the polyester prepolymer to react with a curing agent in a toner production process.

During the toner production process, urethane and/or urea bonds are formed by the reaction with the curing agent. As the urethane and/or urea bonds behave like strong cross-linking points, rubbery property of the amorphous polyester resin A becomes stronger and heat-resistant storage stability and high-temperature offset resistance are more improved. Thus, it is more preferable that the R2 moiety comprises an isocyanate-modified polyester resin.

To lower the Tg of the amorphous polyester resin A and make it easier to impart deformability at low temperatures, the amorphous polyester resin A preferably contains a diol component which comprises an aliphatic diol having 3 to 12 carbon atoms, more preferably an aliphatic diol having 4 to 12 carbon atoms.

Preferably, the amorphous polyester resin A contains the aliphatic diol having 3 to 12 carbon atoms in an amount of 50% by mol or more, more preferably 80% by mol or more, and still more preferably 90% by mol or more.

Specific examples of the aliphatic diol having 3 to 12 carbon atoms include, but are not limited to, 1,3-propanediol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol.

More preferably, the diol component in the amorphous polyester resin A comprises an aliphatic diol having 4 to 12 carbon atoms which has an odd number of carbon atoms in the main chain and an alkyl group on a side chain.

Examples of the aliphatic diol having 4 to 12 carbon atoms which has an odd number of carbon atoms in the main chain and an alkyl group on a side chain include, but are not limited to, an aliphatic diol represented by the following general formula (1).

$$HO—(CR1R2)_n\text{-}OH \quad \text{General Formula (1)}$$

In the general formula (1), R1 and R2 each independently represent a hydrogen atom or an alkyl group having 1 to 3 carbon atoms, and n represents an odd number of from 3 to 9. In n repeating units, R1 may be either the same or different. In addition, in n repeating units, R2 may be either the same or different.

Further, to lower the Tg of the amorphous polyester resin A and make it easier to impart deformability at low temperatures, the amorphous polyester resin A preferably contains an aliphatic diol having 3 to 12 carbon atoms in an amount of 50% by mol or more based on total amount alcohol components.

To lower the Tg of the amorphous polyester resin A and make it easier to impart deformability at low temperatures, the amorphous polyester resin A preferably contains a dicarboxylic acid component which comprises an aliphatic dicarboxylic acid having 4 to 12 carbon atoms.

Preferably, the amorphous polyester resin A contains the aliphatic dicarboxylic acid having 4 to 12 carbon atoms in an amount of 30% by mol or more.

Examples of the aliphatic dicarboxylic acid having 4 to 12 carbon atoms include, but are not limited to, succinic acid, glutaric acid, adipic acid, pimelic acid, suberic acid, azelaic acid, sebacic acid, and dodecanedioic acid.

Diol Component

Specific examples of the diol component include, but are not limited to: aliphatic diols such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; oxyalkylene-group-containing diols such as diethylene glycol, triethylene glycol, dipropylene glycol, polyethylene glycol, polypropylene glycol, and polytetramethylene glycol; alicyclic diols such as 1,4-cyclohexanedimethanol and hydrogenated bisphenol A; alkylene oxide (e.g., ethylene oxide, propylene oxide, and butylene oxide) adducts of alicyclic diols; bisphenols such as bisphenol A, bisphenol F, and bisphenol S; and alkylene oxide (e.g., ethylene oxide, propylene oxide, and butylene oxide) adducts of bisphenols. Among these, aliphatic diols having 4 to 12 carbon atoms are preferable.

Each of these diols can be used alone or in combination with others.

Dicarboxylic Acid Component

Examples of the dicarboxylic acid include, but are not limited to, aliphatic dicarboxylic acids and aromatic dicarboxylic acids. In addition, anhydrides, lower alkyl (C1-C3) esters, and halides thereof may also be used.

Specific examples of the aliphatic dicarboxylic acids include, but are not limited to, succinic acid, adipic acid, sebacic acid, dodecanedioic acid, maleic acid, and fumaric acid.

Specific preferred examples of the aromatic dicarboxylic acids include, but are not limited to, those having 8 to 20 carbon atoms.

Specific examples of the aromatic dicarboxylic acids having 8 to 20 carbon atoms include, but are not limited to, phthalic acid, isophthalic acid, terephthalic acid, and naphthalene dicarboxylic acids.

Among these dicarboxylic acids, aliphatic dicarboxylic acids having 4 to 12 carbon atoms are preferable.

Each of these dicarboxylic acids can be used alone or in combination with others.

Polyisocyanate

Examples of the polyisocyanate include, but are not limited to, diisocyanates and isocyanates having a valence of 3 or more.

Specific examples of the diisocyanates include, but are not limited to, aliphatic diisocyanates, alicyclic diisocyanates, aromatic diisocyanates, aromatic aliphatic diisocyanates, isocyanurates, and these diisocyanates blocked with a phenol derivative, oxime, or caprolactam.

Specific examples of the isocyanates having a valence of 3 or more include, but are not limited to, lysine triisocyanate, a product obtained by reacting an alcohol having a valence of 3 or more with a diisocyanate, and an isocyanurate formed by reacting an alcohol having a valence of 3 or more with a polyisocyanate.

Among these material, polyisocyanates having an isocyanurate backbone are preferable because they function as stronger cross-linking points and provide excellent heat-resistant storage stability and high-temperature offset resistance.

Preferably, a trivalent isocyanate component accounts for 0.2% to 1.0% by mol of THF-insoluble resin components in the toner. In a case in which a cross-linked structure is formed by the trivalent isocyanate component, cohesive force of the molecular chain is increased due to pseudo-cross-linking of urethane and/or urea bonds at the cross-linking points, so that heat-resistant storage stability can be improved even when the cross-linking density is small, thus achieving low-temperature fixability at a high level. When the trivalent isocyanate component accounts for less than 0.2% by mol, the network structure may be non-uniform due to insufficient formation of a branched structure, thereby deteriorating heat-resistant storage stability and filming resistance. When the trivalent isocyanate component accounts for 1.0% by mol or more, a dense cross-linked structure may be formed, thereby deteriorating low-temperature fixability.

Specific examples of the aliphatic diisocyanates include, but are not limited to, tetramethylene diisocyanate, hexamethylene diisocyanate, methyl 2,6-diisocyanatocaproate, octamethylene diisocyanate, decamethine diisocyanate, dodecamethylene diisocyanate, tetradecamethylene diisocyanate, trimethylhexane diisocyanate, and tetramethylhexane diisocyanate.

Specific examples of the alicyclic diisocyanates include, but are not limited to, isophorone diisocyanate and cyclohexylmethane diisocyanate.

Specific examples of the aromatic diisocyanates include, but are not limited to, tolylene diisocyanate, diisocyanatodiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

Specific examples of the aromatic aliphatic diisocyanates include, but are not limited to, $\alpha,\alpha,\alpha',\alpha'$-tetramethylxylylene diisocyanate.

Specific examples of the isocyanurates include, but are not limited to, tris(isocyanatoalkyl) isocyanurate and tris (isocyanatocycloalkyl) isocyanurate.

Each of these polyisocyanates can be used alone or in combination with others.

Curing Agent

The curing agent is not particularly limited as long as it is capable of reacting with a polyester prepolymer (i.e., a reaction product of the polyester moiety of R2 and the polyisocyanate, that is, a reaction precursor to be reacted with the curing agent) to form the polyester resin, and can be selected appropriately according to the purpose. Examples thereof include, but are not limited to, compounds having an active hydrogen group.

Compound Having Active Hydrogen Group

Specific examples of the active hydrogen group in the compound include, but are not limited to, hydroxyl groups (e.g., alcoholic hydroxyl group and phenolic hydroxyl group), amino group, carboxyl group, and mercapto group. Each of these active hydrogen groups can be included in the compound alone or in combination with others.

Preferably, the compound having an active hydrogen group is an amine, because amines are capable of forming urea bond.

Examples of the amine include, but are not limited to, diamines, amines having a valence of 3 or more, amino alcohols, amino mercaptans, amino acids, and these amines in which the amino group is blocked. Each of these amines can be used alone or in combination with others.

In particular, diamine alone and a mixture of a diamine and a small amount of an amine having a valence of 3 or more are preferable.

Examples of the diamines include, but are not limited to, aromatic diamines, alicyclic diamines, and aliphatic diamines. Specific examples of the aromatic diamines include, but are not limited to, phenylenediamine, diethyltoluenediamine, and 4,4'-diaminodiphenylmethane. Specific examples of the alicyclic diamines include, but are not limited to, 4,4'-diamino-3,3'-dimethyldicyclohexylmethane, diaminocyclohexane, and isophoronediamine. Specific examples of the aliphatic diamines include, but are not limited to, ethylenediamine, tetramethylenediamine, and hexamethylenediamine.

Specific examples of the amines having a valence of 3 or more include, but are not limited to, diethylenetriamine and triethylenetetramine.

Specific examples of the amino alcohols include, but are not limited to, ethanolamine and hydroxyethylaniline.

Specific examples of the amino mercaptans include, but are not limited to, aminoethyl mercaptan and aminopropyl mercaptan.

Specific examples of the amino acid include, but are not limited to, aminopropionic acid and aminocaproic acid.

Specific examples of the amines in which the amino group is blocked include, but are not limited to, ketimine compounds obtained by blocking the amino group with a ketone such as acetone, methyl ethyl ketone, and methyl isobutyl ketone, and oxazoline compounds.

The amorphous polyester resin A preferably has a glass transition temperature of from −60° C. to 0° C., more preferably from −40° C. to −20° C.

When the glass transition temperature is lower than −60° C., the toner cannot be suppressed from at low temperatures, resulting in deterioration of heat-resistant storage stability and filming resistance.

When the glass transition temperature is higher than 0° C., the toner cannot sufficiently deform when heated and pressed at the time of fixing, resulting in poor low-temperature fixability.

Preferably, the R1 moiety in the above-described structural formulae 1) to 3) of the amorphous polyester resin A has an isocyanurate backbone represented by the following structural formula (I) for heat-resistant storage stability and high-temperature offset resistance.

(I)

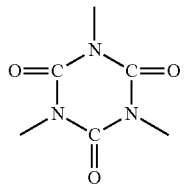

Although detailed reason has not been clear, n is preferably 3 in the above structural formulae 1) to 3), because the three-dimensional network structure of the molecule of the amorphous polyester resin A thereby becomes a suitable state for achieving low-temperature fixability, image gloss, heat-resistant storage stability, and offset resistance.

The amorphous polyester resin A preferably has a weight average molecular weight of from 20,000 to 1,000,000 when measured by GPC (gel permeation chromatography).

The weight average molecular weight of the amorphous polyester resin A refers to that of the reaction product of the reactive precursor with the curing agent.

When the weight average molecular weight is less than 20,000, the toner becomes more flowable at low temperatures, resulting in poor heat-resistant storage stability.

In addition, viscoelasticity of the toner becomes too low when the toner melts, resulting in deterioration of high-temperature offset resistance.

The content of the amorphous polyester resin A in 100 parts by mass of the toner is preferably in the range of from 1 to 10 parts by mass, more preferably from 1 to 5 parts by mass.

Amorphous Polyester Resin B

The amorphous polyester resin B may contain, for example, a diol component and a dicarboxylic acid component as constituents. The amorphous polyester resin B contains urethane bond or urea bond like the amorphous polyester resin A.

The amorphous polyester resin B may be produced in the same manner as the amorphous polyester resin A. However, it is to be noted that the R1 moiety in the amorphous polyester resin B is trimellitic acid.

The amorphous polyester resin B preferably has a glass transition temperature of 30° C. or higher and lower than 70° C. when measured by a method described later.

When the glass transition temperature is too low, heat-resistant storage stability and endurance against stress, such as that caused by stirring in developing device, of the toner may be poor. When the glass transition temperature is too high, viscoelasticity of the toner becomes too high when the toner melts, resulting in poor low-temperature fixability.

Diol Component

Specific examples of the diol component include, but are not limited to: alkylene (C2-C3) oxide adducts of bisphenol A with an average addition molar number of 1 to 10 (e.g., polyoxypropylene(2.2)-2,2-bis(4-hydroxyphenyl)propane and polyoxyethylene(2.2)-2,2-bis(4-hydroxyphenyl)propane); and ethylene glycol, propylene glycol, hydrogenated bisphenol A, and alkylene (C2-C3) oxide adducts of these compounds with an average addition molar number of 1 to 10.

Each of these compounds can be used alone or in combination with others.

Dicarboxylic Acid Component

Specific examples of the dicarboxylic acid component include, but are not limited to: dicarboxylic acids such as adipic acid, phthalic acid, isophthalic acid, terephthalic acid, fumaric acid, and maleic acid; and succinic acids substituted with an alkyl group having 1 to 20 carbon atoms or an alkenyl group having 2 to 20 carbon atoms, such as dodecenyl succinic acid and octyl succinic acid.

Each of these compounds can be used alone or in combination with others.

The isocyanate components exemplified above for preparing the amorphous polyester resin A can be used for preparing the amorphous polyester resin B either.

Preferred are aromatic diisocyanates having 6 to 15 carbon atoms, aliphatic diisocyanates having 4 to 12 carbon atoms, and alicyclic diisocyanates having 4 to 15 carbon atoms. More preferred are toluene diisocyanate (TDI), methylene diphenyl diisocyanate (MDI), hexamethylene diisocyanate (HDI), hydrogenated MDI, and isophorone diisocyanate (IPDI).

For the purpose of adjusting acid value and hydroxyl value, the resin chain may include a polycarboxylic acid having a valence of 3 or more, such as trimellitic acid, pyromellitic acid, and an anhydride thereof, or a polyol having a valence of 3 or more, such as glycerin, pentaerythritol, and trimethylolpropane, on a terminal.

The amorphous polyester resin B preferably has an acid value of from 1 to 50 mgKOH/g, more preferably from 5 to 30 mgKOH/g.

When the acid value is 1 mgKOH/g or higher, the toner becomes more negatively-chargeable and more compatible with paper when being fixed thereon, improving low-temperature fixability.

When the acid value is higher than 50 mgKOH/g, charge stability, particularly charge stability against environmental fluctuation, may deteriorate.

The amorphous polyester resin B preferably has a hydroxyl value of 5 mgKOH/g or higher.

The content of the amorphous polyester resin B in 100 parts by mass of the toner is preferably in the range of from 3 to 15 parts by mass, more preferably from 3 to 7 parts by mass.

The molecular structure of the amorphous polyester resins A and B can be determined by, for example, solution or solid NMR (nuclear magnetic resonance), X-ray diffractometry, GC/MS (gas chromatography-mass spectroscopy), LC/MS (liquid chromatography-mass spectroscopy), or TR (infrared spectroscopy).

For example, IR can simply detect an amorphous polyester resin as a substance showing no absorption peak based on δCH (out-of-plane bending vibration) of olefin at 965±10 $cm^{-1}$ and 990±10 $cm^{-1}$ in an infrared absorption spectrum.

Other Polyester Resin

The toner according to an embodiment of the present invention may further contain a polyester resin other than the above-described polyester resins (hereinafter "the other polyester resin") as a binder resin.

The other polyester resin has a backbone derived from an alcohol component and another backbone derived from a carboxylic acid component.

Preferably, the alcohol component includes an aliphatic alcohol having a valence of 3 or more.

The other polyester resin satisfies the following formulae (1) to (3).

500≤(Weight Average Molecular Weight (Mw))/((Valence of Aliphatic Alcohol Having Valence of 3 or More)×(Amount of Aliphatic Alcohol Having Valence of 3 or More))≤4,000 Formula (1)

4,000≤Weight Average Molecular Weight (Mw)≤25,000 Formula (2)

0.5≤(Amount of Aliphatic Alcohol Having Valence of 3 or More)≤6.5 Formula (3)

In the above formulae (1) and (3), "Amount of Aliphatic Alcohol Having Valence of 3 or More" (hereinafter may also be referred to as "amount of branching components") refers to the molar percent of the aliphatic alcohol having a valence of 3 or more based on the alcohol component.

Here, when the alcohol component comprises two or more types of aliphatic alcohols having a valence of 3 or more, the "Valence of Aliphatic Alcohol Having Valence of 3 or More" is an average valence determined from the molar fraction of each aliphatic alcohol having a valence of 3 or more. For example, when the aliphatic alcohol having a valence of 3 or more comprises 50% by mol of a trivalent aliphatic alcohol and 50% by mol of a tetravalent aliphatic alcohol, the "Valence of Aliphatic Alcohol Having Valence of 3 or More" becomes 3×0.5+4×0.5=3.5. As another example, when the aliphatic alcohol having a valence of 3 or more comprises 60% by mol of a trivalent aliphatic alcohol and 40% by mol of a hexavalent aliphatic alcohol, the "Valence of Aliphatic Alcohol Having Valence of 3 or More" becomes 3×0.6+6×0.4=4.2.

When the other polyester resin satisfies the above formulae (1) to (3), low-temperature fixability, stress resistance, and blocking resistance of toner image are improved.

The following part of the formula (1) represents the average distance between the branches in the polyester resin ("inter-branch distance").

(Weight Average Molecular Weight (Mw))/((Valence of Aliphatic Alcohol Having Valence of 3 or More)×(Amount of Aliphatic Alcohol Having Valence of 3 or More))

Preferably, the other polyester resin satisfies the above formula (1) and further satisfies the following formula (1-1).

800≤(Weight Average Molecular Weight (Mw))/((Valence of Aliphatic Alcohol Having Valence of 3 or More)×(Amount of Aliphatic Alcohol Having Valence of 3 or More))≤2,000 Formula (1-1)

In the above formula (1-1), "Amount of Aliphatic Alcohol Having Valence of 3 or More" refers to the molar percent of the aliphatic alcohol having a valence of 3 or more based on the alcohol component.

When the inter-branch distance exceeds 4,000, melt viscosity hardly decreases, which is disadvantageous to low-temperature fixability. When the inter-branch distance is less than 500, the distance between branches becomes shorter and the molecular size becomes smaller, so that the stress resistance of the toner deteriorates. In addition, the start of molecular entanglement is delayed when the molecules are cooled from a high temperature, resulting in deterioration of blocking resistance of the outputted toner image.

It is possible for polyester resins having a branched structure to reduce melt viscosity at high temperatures while maintaining the glass transition temperature, thereby improving low-temperature fixability and heat-resistant storage stability of the toner. At the same time, stress resistance of the toner is excellent since deformation of the polyester resin is suppressed even when a large stress is applied thereto due to the presence of a dense three-dimensional structure portion inside formed of a large amount of branching component.

The other polyester resin preferably satisfies the above formula (2) and further satisfies the following formula (2-1).

8,000≤Weight Average Molecular Weight (Mw)≤20,000 Formula (2-1)

When the weight average molecular weight of the other polyester resin is less than 4,000, high-temperature-resistant high-humidity-resistant storage stability and stress resistance of the toner deteriorate. When the weight average molecular weight exceeds 30,000, melt viscosity is too high to develop low-temperature fixability.

Preferably, the other polyester resin satisfies the above formula (3) and further satisfies the following formula (3-1).

2.0≤(Amount of Aliphatic Alcohol Having Valence of 3 or More)≤4.0 Formula (3-1)

In the above formula (3-1), "Amount of Aliphatic Alcohol Having Valence of 3 or More" refers to the molar percent of the aliphatic alcohol having a valence of 3 or more based on the alcohol component.

When the "Amount of Aliphatic Alcohol Having Valence of 3 or More" (i.e., amount of branching components) is less than 0.5% by mol, high-temperature-resistant high-humidity-resistant storage stability and filming resistance deteriorate, and when it exceeds 6.5% by mol, image gloss and low-temperature fixability deteriorate.

Preferably, the other polyester resin is produced by reacting an alcohol component comprising an aliphatic alcohol having a valence of 3 or more with a carboxylic acid component. By this procedure, a polyester resin having a branched structure is obtained.

The other polyester resin preferably has a glass transition temperature (Tg) of from 40° C. to 70° C., more preferably from 50° C. to 60° C.

When the glass transition temperature is less than 40° C., heat-resistant storage stability, resistance to stress such as that caused by stirring in a developing device, and filming resistance of the toner may deteriorate.

When the glass transition temperature is in excess of 70° C., the toner cannot sufficiently deform when heated and pressed at the time of fixing, resulting in poor low-temperature fixability.

Preferably, the other polyester resin is soluble in tetrahydrofuran (THF) for low-temperature fixability and high image gloss.

Alcohol Component

Examples of the alcohol component include, but are not limited to, divalent alcohols and alcohols having a valence of 3 or more.

Preferably, the alcohol component includes an aliphatic alcohol having a valence of 3 or more.

Specific examples of the divalent alcohols include, but are not limited to, aliphatic diols, diols having oxyalkylene group, alicyclic diols, alkylene oxide (e.g., ethylene oxide, propylene oxide, butylene oxide) adducts of alicyclic diols, bisphenols, and alkylene oxide adducts of bisphenols.

Specific examples of the aliphatic diols include, but are not limited to, ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol.

Specific examples of the diols having oxyalkylene group include, but are not limited to, diethylene glycol, triethylene glycol, dipropylene glycol, polyethylene glycol, polypropylene glycol, and polytetramethylene glycol.

Specific examples of the alicyclic diols include, but are not limited to, 1,4-cyclohexanedimethanol and hydrogenated bisphenol A.

Specific examples of the bisphenols include, but are not limited to, bisphenol A, bisphenol F, and bisphenol S.

Specific examples of the alkylene oxide adducts of bisphenols include, but are not limited to, bisphenols to which an alkylene oxide, such as ethylene oxide, propylene oxide, and butylene oxide, is adducted.

Specific examples of the alcohols having a valence of 3 or more include, but are not limited to, aliphatic alcohols having a valence of 3 or more.

Specific examples of the aliphatic alcohols having a valence of 3 or more include, but are not limited to, glycerin, trimethylolethane, trimethylolpropane, pentaerythritol, sorbitol, and dip entaerythritol.

Preferred examples of the aliphatic alcohols having a valence of 3 or more include those having a valence of 3 to 4.

Carboxylic Acid Component

Examples of the carboxylic acid component include, but are not limited to, divalent carboxylic acids and carboxylic acids having a valence of 3 or more. In addition, anhydrides, lower alkyl (C1-C3) esters, and halides thereof may also be used.

Examples of the divalent carboxylic acids include, but are not limited to, aliphatic dicarboxylic acids and aromatic dicarboxylic acids.

Specific examples of the aliphatic dicarboxylic acids include, but are not limited to, succinic acid, adipic acid, sebacic acid, dodecanedioic acid, maleic acid, and fumaric acid.

Specific examples of the aromatic dicarboxylic acids include, but are not limited to, phthalic acid, isophthalic acid, terephthalic acid, and naphthalene dicarboxylic acids.

Specific examples of the carboxylic acids having a valence of 3 or more include, but are not limited to, trimellitic acid and pyromellitic acid.

Each of these carboxylic acid components can be used alone or in combination with others.

Crystalline Polyester Resin

The crystalline polyester resin has a heat melting property such that the viscosity rapidly decreases at around the fixing start temperature due to its high crystallinity. When used in combination with the amorphous polyester resin, the crystalline polyester resin can maintain good storage stability below the melting start temperature due to its crystallinity, but upon reaching the melting start temperature, the crystalline polyester resin melts while rapidly reducing its viscosity ("sharply-melting property"). The crystalline polyester resin then compatibilizes with the amorphous polyester resin and together rapidly reduces viscosity to be fixed on a recording medium. Thus, the toner exhibits excellent heat-resistant storage stability and low-temperature fixability. Such a toner also exhibits a wide releasable range (i.e., the difference between the lowest fixable temperature and the high-temperature offset generating temperature).

The crystalline polyester resin is obtained from a polyol and a polycarboxylic acid or derivative thereof, such as a polycarboxylic acid anhydride and a polycarboxylic acid ester.

In the present disclosure, the crystalline polyester resin refers to a resin obtained from a polyol and a polycarboxylic acid or derivative thereof, such as a polycarboxylic acid anhydride and a polycarboxylic acid ester. Modified polyester resins, such as the prepolymer described above and resins obtained by cross-linking and/or elongating the prepolymer, do not fall within the crystalline polyester resin of the present disclosure.

Whether the crystalline polyester resin has crystallinity or not can be confirmed by a crystal analysis X-ray diffractometer (e.g., X'PERT PRO MRD from Koninklijke Philips N.V.). A measurement method is described below.

First, a target sample is ground by a mortar to prepare a sample powder, and the obtained sample powder is uniformly applied to a sample holder. The sample holder is set in the diffractometer, and a measurement is performed to obtain a diffraction spectrum.

It is determined that the sample has crystallinity when the half value width of the diffraction peak having the highest peak intensity among the diffraction peaks observed in the range of $20° < 2\theta < 25°$ is 2.0 or less.

In the present disclosure, a polyester resin which does not satisfy this condition is referred to as an amorphous polyester resin in contrast to the crystalline polyester resin.

Measurement conditions for X-ray diffraction are described below. Measurement Conditions Tension kV: 45 kV Current: 40 mA MPSS Upper Gonio Scanmode: continuos Start angle: 3° End angle: 35° Angle Step: 0.02° Lucident beam optics Divergence slit: Div slit ½ Diffraction beam optics Anti scatter slit: As Fixed ½ Receiving slit: Prog rec slit Polyol Examples of the polyol include, but are not limited to, diols and alcohols having a valence of 3 or more.

Examples of the diols include, but are not limited to, saturated aliphatic diols. Examples of the saturated aliphatic diols include, but are not limited to, straight-chain saturated aliphatic diols and branched saturated aliphatic diols. In particular, straight-chain saturated aliphatic diols are preferable, and straight-chain saturated aliphatic diols having 2 to 12 carbon atoms are more preferable. The branched saturated aliphatic diols may reduce crystallinity of the crystalline polyester resin and further reduce the melting point thereof. Saturated aliphatic diols having more than 12 carbon atoms are not easily available. Thus, preferably, the number of carbon atoms is 12 or less.

Specific examples of the saturated aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanediol. Among these diols, ethylene glycol, 1,4-butanediol, 1,6-hexanediol, 1,8-octanediol, 1,10-decanediol, and 1,12-dodecanediol are preferable for obtaining a crystalline polyester resin having high crystallinity and sharply-melting property.

Specific examples of the alcohols having a valence of 3 or more include, but are not limited to, glycerin, trimethylolethane, trimethylolpropane, and pentaerythritol. Each of these compounds can be used alone or in combination with others.

Polycarboxylic Acid

Examples of the polycarboxylic acid include, but are not limited to, dicarboxylic acids and carboxylic acids having a valence of 3 or more.

Specific examples of the dicarboxylic acids include, but are not limited to, saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as diprotic acids such as phthalic acid, isophthalic acid, terephthalic acid, naphthalene-2,6-dicarboxylic acid, malonic acid, and mesaconic acid; and anhydrides and lower alkyl esters (C1-C3) thereof.

Specific examples of the carboxylic acids having a valence of 3 or more include, but are not limited to, 1,2,4-benzenetricarboxylic acid, 1,2,5-benzenetricarboxylic acid, 1,2,4-naphthalenetricarboxylic acid, and anhydrides and lower alkyl esters (C1-C3) thereof.

The polycarboxylic acid may further include a dicarboxylic acid having sulfonic acid group, other than the above-described saturated aliphatic dicarboxylic acid or aromatic dicarboxylic acid. In addition, the polycarboxylic acid may further include a dicarboxylic acid having a double bond, other than the above-described saturated aliphatic dicarboxylic acid or aromatic dicarboxylic acid. Each of these compounds can be used alone or in combination with others.

Preferably, the crystalline polyester resin comprises a straight-chain saturated aliphatic dicarboxylic acid having 4 to 12 carbon atoms and a straight-chain saturated aliphatic diol having 2 to 12 carbon atoms. In other words, preferably, the crystalline polyester resin has a structural unit derived from a saturated aliphatic dicarboxylic acid having 4 to 12 carbon atoms and another structural unit derived from a saturated aliphatic diol having 2 to 12 carbon atoms. Such a crystalline polyester resin has high crystallinity and sharply-melting property and thus exerts excellent low-temperature fixability, which is preferable.

Preferably, the melting point of the crystalline polyester resin is in the range of from 60° C. to 80° C., but is not limited thereto. When the melting point is less than 60° C., the crystalline polyester resin is likely to melt at low temperatures, resulting in deterioration of heat-resistant storage stability of the toner. When the melting point is in excess of 80° C., melting of the crystalline polyester resin upon application of heat at the time of fixing is insufficient, resulting in deterioration of low-temperature fixability.

The molecular weight of the crystalline polyester resin is not limited to any particular value. As the molecular weight distribution becomes narrower and the molecular weight becomes lower, low-temperature fixability improves. As the amount of low-molecular-weight components increases, heat-resistant storage stability deteriorates. In view of this, preferably, ortho-dichlorobenzene-soluble matter in the crystalline polyester resin has a weight average molecular weight (Mw) of from 3,000 to 30,000 and a number average molecular weight (Mn) of from 1,000 to 10,000, and a ratio Mw/Mn of from 1.0 to 10, when measured by GPC (gel permeation chromatography). More preferably, the weight average molecular weight (Mw) is from 5,000 to 15,000, the number average molecular weight (Mn) is from 2,000 to 10,000, and the ratio Mw/Mn is from 1.0 to 5.0.

Preferably, the acid value of the crystalline polyester resin is 5 mgKOH/g or more, more preferably 10 mgKOH/g or more, for achieving a desired level of low-temperature fixability in terms of affinity for paper, but is not limited thereto. On the other hand, for improving high-temperature offset resistance, the acid value is preferably 45 mgKOH/g or less.

Preferably, the hydroxyl value of the crystalline polyester resin is in the range of from 0 to 50 mgKOH/g, more preferably from 5 to 50 mgKOH/g, for achieving a desired level of low-temperature fixability and a good level of charge property, but is not limited thereto.

The molecular structure of the crystalline polyester resin can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect a crystalline polyester resin as a substance showing an absorption peak based on δCH (out-of-plane bending vibration) of olefin at 965±10 $cm^{-1}$ or 990±10 $cm^{-1}$ in an infrared absorption spectrum.

Preferably, the content of the crystalline polyester resin in 100 parts by mass of the toner is in the range of from 3 to 20 parts by mass, more preferably from 5 to 15 parts by mass. When the content is less than 3 parts by mass, sharply-melting property of the crystalline polyester resin may be insufficient, resulting in deterioration of low-temperature fixability. When the content is in excess of 20 parts by mass, heat-resistant storage stability may deteriorate and image fog may be caused. When the content is within the preferred range, image quality and low-temperature fixability are all excellent.

Other Components

The toner according to an embodiment of the present invention contains a release agent and a colorant as requisite components. The toner may further contain other components such as a charge control agent, an external additive, a fluidity improving agent, a cleanability improving agent, and a magnetic material.

Release Agent

The release agent is not limited to any particular material and selected from known materials.

Specific examples of the release agent include, but are not limited to, waxes such as natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, microcrystalline wax, petrolatum wax).

Specific examples of the release agent further include, but are not limited to, synthetic hydrocarbon waxes (e.g., Fischer-Tropsch wax, polyethylene wax, polypropylene wax) and synthetic waxes (e.g., ester wax, ketone wax, ether wax).

Furthermore, the following materials are also usable as the release agent: fatty acid amide compounds such as 12-hydroxystearic acid amide, stearic acid amide, phthalic anhydride imide, and chlorinated hydrocarbon; homopolymers and copolymers of polyacrylates (e.g., poly-n-stearyl methacrylate, poly-n-lauryl methacrylate), which are low-molecular-weight crystalline polymers; and crystalline polymers having a long alkyl side chain.

Among these materials, hydrocarbon waxes such as paraffin wax, micro-crystalline wax, Fischer-Tropsch wax, polyethylene wax, and polypropylene wax are preferable.

Preferably, the melting point of the release agent is in the range of from 60° C. to 80° C., but is not limited thereto. When the melting point is less than 60° C., the release agent easily melts at low temperatures, resulting in poor heat-resistant storage stability. When the melting point is in excess of 80° C., the release agent insufficiently melts even when the resin melts within the fixable temperature range, causing fixation offset and defective image.

Preferably, the content of the release agent in 100 parts by mass of the toner is in the range of from 2 to 10 parts by mass, more preferably from 3 to 8 parts by mass. When the content is less than 2 parts by weight, high-temperature offset resistance at the time of fixing and low-temperature fixability may deteriorate. When the content is in excess of 10 parts by weight, heat-resistant storage stability may deteriorate and image fog may occur. When the content is within the preferred range, image quality and fixing stability are advantageously improved.

Colorant

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone.

Preferably, the content of the colorant in 100 parts by mass of the toner is in the range of from 1 to 15 parts by mass, more preferably from 3 to 10 parts by mass.

The colorant can be combined with a resin to be used as a master batch. Specific examples of the resin to be used for the master batch include, but are not limited to, the above-described other polyester resin, polymers of styrene or a derivative thereof (e.g., polystyrene, poly-p-chlorostyrene, polyvinyl toluene), styrene-based copolymers (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Each of these compounds can be used alone or in combination with others.

The master batch can be obtained by mixing and kneading the resin and the colorant while applying a high shearing force thereto. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

Charge Controlling Agent

Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives.

Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), available from Orient Chemical Industries Co., Ltd.; TP-302 and TP-415 (molybdenum complexes of quaternary ammonium salts), available from Hodogaya Chemical Co., Ltd.; LRA-901, and LR-147 (boron complex), all available from Japan Carlit Co., Ltd.; and cooper phthalocyanine, perylene, quinacridone, azo pigments, and polymers having a functional group such as a sulfonic acid group, a carboxyl group, and a quaternary ammonium group.

Preferably, the content of the charge control agent in 100 parts by mass of the toner is in the range of from 0.1 to 10 parts by mass, more preferably from 0.2 to 5 parts by mass. When the content is in excess of 10 parts by mass, chargeability of the toner becomes so large that the main effect of the charge control agent is reduced. As a result, the electrostatic force between the toner and a developing roller is increased and fluidity of the developer and image density are lowered. The charge controlling agent may be first mixed with the master batch or the binder resin and thereafter dissolved or dispersed in an organic solvent, or directly added to an organic solvent at the time of dissolving or dispersing. Alternatively, the charge controlling agent may be fixed on the surface of the resulting toner particles.

External Additive

Specific examples of usable external additives include, but are not limited to, fine oxide particles, fine inorganic particles, and fine hydrophobized inorganic particles, and combinations thereof. In particular, fine hydrophobized inorganic particles, the primary particles of which having an average particle diameter of from 1 to 100 nm, more preferably from 5 to 70 nm, are preferable.

More preferably, the external additive includes at least one type of fine hydrophobized inorganic particle the primary particles of which having an average particle diameter of 20 nm or less, and at least one type of fine inorganic particle the primary particles of which having an average particle diameter of 30 nm or more. Preferably, the BET specific surface area of the external additive is from 20 to 500 $m^2/g$.

Specific examples of the external additive include, but are not limited to, fine particles of silica, hydrophobic silica, metal salts of fatty acids (e.g., zinc stearate and aluminum stearate), metal oxides (e.g., titania, alumina, tin oxide, and antimony oxide), and fluoropolymers.

Specific preferred examples of the external additive include, but are not limited to, fine particles of hydrophobized silica, titania, titanium oxide, and alumina. Specific examples of commercially-available fine particles of silica include, but are not limited to, R972, R974, RX200, RY200, R202, R805, and R812 (available from Nippon Aerosil Co., Ltd.). Specific examples of commercially-available fine particles of titania include, but are not limited to, P-25 (available from Nippon Aerosil Co., Ltd.); STT-30 and STT-65C-S (available from Titan Kogyo, Ltd.); TAF-140 (available from Fuji Titanium Industry Co., Ltd.); and MT-150W, MT-500B, MT-600B, and MT-150A (available from TAYCA Corporation).

Specific examples of commercially-available fine particles of hydrophobized titanium oxide include, but are not limited to, T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S and MT-100T (available from TAYCA Corporation); and IT-S (available from Ishihara Sangyo Kaisha, Ltd.).

The fine particles of hydrophobized oxides, hydrophobized silica, hydrophobized titania, and hydrophobized alumina can be obtained by treating fine particles of oxides, silica, titania, and alumina, respectively, which are hydrophilic, with a silane coupling agent such as methyltrimethoxysilane, methyltriethoxysilane, and octyltrimethoxysilane. In addition, fine particles of oxides and fine inorganic particle which are treated with a silicone oil, optionally upon application of heat, are also preferable.

Specific examples of the silicone oil include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methyl styrene-modified silicone oil.

Specific examples of the fine inorganic particles include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, silica and titanium dioxide are preferable.

Preferably, the content of the external additive in 100 parts by mass of the toner is in the range of from 0.1 to 5 parts by mass, more preferably from 0.3 to 3 parts by mass.

Preferably, the average particle diameter of the primary particles of the fine inorganic particle is 100 nm or less, more preferably in the range of from 3 to 70 nm, but is not limited thereto. When the average particle diameter is below the preferred range, the fine inorganic particle may be embedded in the toner and cannot effectively exhibit their function. When the average particle diameter is above the preferred range, the fine inorganic particle may unevenly make flaws on the surface of the photoconductor.

Fluidity Improving Agent

The fluidity improving agent refers to a surface treatment agent that improves hydrophobicity of the toner to prevent deterioration of fluidity and chargeability of the toner even under high-humidity environments. Specific examples of the fluidity improving agent include, but are not limited to, silane coupling agents, silylation agents, silane coupling agents having a fluorinated alkyl group, organic titanate coupling agents, aluminum coupling agents, silicone oils, and modified silicone oils. Preferably, the above-described silica and titanium oxide are surface-treated with such a fluidity improving agent to become hydrophobic silica and hydrophobic titanium oxide, respectively.

Cleanability Improving Agent

The cleanability improving agent is an additive that facilitates easy removal of the toner remaining on a photoconductor or primary transfer medium after image transfer. Specific examples of the cleanability improving agent include, but are not limited to, metal salts of fatty acids (e.g., zinc stearate and calcium stearate) and fine particles of polymers prepared by soap-free emulsion polymerization (e.g., polymethyl methacrylate and polystyrene). Preferably, the particle size distribution of the fine particles of polymers is as narrow as possible. More preferably, the volume average particle diameter thereof is in the range of from 0.01 to 1 μm.

Magnetic Material

Specific examples of usable magnetic materials include, but are not limited to, iron powder, magnetite, and ferrite. In particular, those having white color tone are preferable. T1/2

Preferably, the toner according to an embodiment of the present invention has a parameter T1/2 of from 105° C. to 125° C. measured according to a temperature rising method by a flow tester. When T1/2 is within the above range, the toner achieves both separation stability and high gloss.

More preferably, the toner has a parameter T1/2 of from 110° C. to 120° C.

The parameter T1/2 of the toner may be determined from a flow curve obtained by a flow tester CFT500 (manufactured by Shimadzu Corporation). Measurement conditions may be as follows.

Measurement Conditions

Load: 30 $kg/cm^2$

Temperature rising rate: 3.0° C./min

Die diameter: 0.50 mm

Die length: 1.0 mm

Measurement temperature: 40° C. to 200° C.

Glass Transition Temperature [Tg1st (toner)]

Preferably, toner has a glass transition temperature (Tg1st (toner)) of from 20° C. to 65° C., more preferably from 50° C. to 65° C., when the glass transition temperature (Tg1st (toner)) is determined from an endothermic curve obtained in a first temperature rising in a measurement by a differential scanning calorimeter.

Conventional toners which have a Tg of 50° C. or less easily cause aggregation when transported in summer season or in tropical regions or stored under a temperature-variable environment. As a result, such a conventional toner may be solidified in a toner bottle or fixedly adhered to a developing device. In these cases, toner clogging occurs within the toner bottle and defective toner supply is caused, or abnormal image is generated due to the occurrence of toner adhesion to the developing device.

The toner according to an embodiment of the present invention has a glass transition temperature lower than that of conventional toners. However, since the polyester resin having a structure represented by any one of the above structural formulae 1) to 3), which is a low Tg component in the toner, is nonlinear, the toner according to an embodiment of the present invention maintains heat-resistant storage stability. Especially when the polyester resin having a structure represented by any one of the structural formulae 1) to 3) has urethane bond or urea bond each having a high cohesive force, the toner can maintain heat-resistant storage stability in a more effective manner.

When Tg1st (toner) is 20° C. or higher, preferably 50° C. or higher, heat-resistant storage stability is improved and the occurrence of blocking in a developing device and filming on a photoconductor can be prevented. When Tg1st (toner) is 65° C. or lower, low-temperature fixability of the toner is further improved.

According to a preferred embodiment of the present invention, the toner contains a polyester resin having a structure represented by any one of the structural formulae 1) to 3) and the other polyester resin and has a [Tg1st (toner)] of from 20° C. to 65° C.

Preferably, the difference (Tg1st-Tg2nd) between Tg1st (toner) and Tg2nd (toner) measured in the first and second temperature rising in the measurement by a differential scanning calorimeter (DSC), respectively, is 10° C. or more, but is not limited thereto. Preferably, the upper limit of the difference (Tg1st-Tg2nd) is 50° C. or less.

When the difference is 10° C. or more, low-temperature fixability is more excellent. When the difference is 10° C. or more, it means that the crystalline polyester resin and the amorphous polyester resin, which have been incompatible with each other before the first heating, get to compatiblize with each other after the first heating.

In this case, the crystalline polyester resin and the amorphous polyester resin need not necessarily in a complete compatibilized state.

Volume Average Particle Diameter

Preferably, the volume average particle diameter of the toner is in the range of from 3 to 7 μm, but is not limited thereto. In addition, preferably, the ratio of the volume average particle diameter to the number average particle diameter is 1.2 or less. Furthermore, preferably, the toner includes toner particles having a volume-based particle diameter of 2 μm or less in an amount of from 1% to 10% by number.

Calculation and Analysis Methods for Various Properties of Toner and Toner Constituents Various properties of the amorphous polyester resin, the crystalline polyester resin, and the release agent, such as solubility parameter (SP), Tg, acid value, hydroxyl value, molecular weight, and melting point, may be measured from the single body thereof. Alternatively, SP, Tg, molecular weight, melting point, and mass ratio of each constituent may be measured from that separated (isolated) from the toner by gel permeation chromatography (GPC), etc., according to analysis procedures to be described later.

For example, each constituent of the toner can be separated from the toner by GPC in the following manner.

In a GPC measurement using THF (tetrahydrofuran) as a mobile phase, the eluate is divided into fractions by a fraction collector, and the fractions corresponding to the desired molecular weight portion in the total area of the elution curve are collected.

The collected fractions of the eluate are condensed and dried by an evaporator, etc. The resulting solid is dissolved in a deuterated solvent, such as deuterated chloroform or deuterated THF, and subjected to $^{1}$H-NMR measurement to determine integrated ratio of each element and calculate the constitutional monomer ratio in the eluted components.

Alternatively, the constitutional monomer ratio may be determined by hydrolyzing the condensed eluate with sodium hydroxide, etc., and subjecting the decomposition product to a qualitative quantitative analysis by high-performance liquid chromatography (HPLC).

In a case in which the toner is produced by a method including the process of forming a polyester resin by causing an elongation reaction and/or a cross-linking reaction between the non-linear reactive precursor and the curing agent while forming mother toner particles, the polyester resin may be separated from the toner by GPC, etc. to determine Tg, etc. from the separated polyester resin. Alternatively, the polyester resin may be previously synthesized by causing an elongation reaction and/or a cross-linking reaction between the non-linear reactive precursor and the curing agent, and the properties such as Tg may be determined from the synthesized polyester resin.

Separation of Toner Constituents

Toner constituents can be separated from the toner in the following manner.

First, 1 g of the toner is poured in 100 mL of THF and stirred at 25° C. for 30 minutes to obtain a solution in which THF-soluble matter is dissolved.

The solution is filtered with a membrane filter having an opening of 0.2 μm to separate (isolate) THF-soluble matter from the toner.

The THF-soluble matter is dissolved in THF to prepare a sample for GPC measurement. The sample is injected into a GPC instrument.

A fraction collector, disposed at the eluate discharge port of the GPC instrument, collects a fraction of the eluate at every predetermined count. Every time the collected fractions correspond to 5% of the area of the elution curve, the collected fractions are separated.

Each separated eluate in an amount of 30 mg is dissolved in 1 mL of deuterated chloroform. As a standard substance, 0.05% by volume of tetramethylsilane (TMS) is further added thereto.

The resulting solution is poured in a glass tube having a diameter of 5 mm and subjected to an NMR measurement using a nuclear magnetic resonance spectrometer (JNM-AL400 available from JEOL Ltd.) to obtain a spectrum. The measurement is performed at a temperature of from 23° C. to 25° C., and the number of accumulation is 128.

The monomer composition and compositional ratio of each toner constituent, such as the amorphous polyester resin and the crystalline polyester resin, can be determined from the peak integral ratio of the spectrum.

Specifically, a compositional ratio of monomers can be determined from an integral ratio determined by peak assignment.

Examples of peak assignment are as follows.

Around 8.25 ppm: derived from benzene ring of trimellitic acid (for one hydrogen atom)

Around 8.07 to 8.10 ppm: derived from benzene ring of terephthalic acid (for four hydrogen atoms)

Around 7.1 to 7.25 ppm: derived from benzene ring of bisphenol A (for four hydrogen atoms)

Around 6.8 ppm: derived from benzene ring of bisphenol A (for four hydrogen atoms) and double bond of fumaric acid (for two hydrogen atoms)

Around 5.2 to 5.4 ppm: derived from methine of propylene oxide adduct of bisphenol A (for one hydrogen atom)

Around 3.7 to 4.7 ppm: derived from methylene of propylene oxide adduct bisphenol A (for two hydrogen atoms) and methylene of ethylene oxide adduct of bisphenol A (for four hydrogen atoms)

Around 1.6 ppm: derived from methyl group of bisphenol A (for six hydrogen atoms)

As a result of peak assignment, the collected fractions of the eluate in which the amorphous polyester resin having a structure represented by any one of the above structural formulae 1) to 3) accounts for 90% or more can be treated as the polyester resin having a structure represented by any one of the above structural formulae 1) to 3).

Similarly, the collected fractions of the elute in which the other polyester resin accounts for 90% or more can be treated as the other polyester resin.

Similarly, the collected fractions of the eluate in which the crystalline polyester resin accounts for 90% or more can be treated as the crystalline polyester resin.

Analysis of THF-Insoluble Matter in Toner

THF-insoluble matter in the toner can be extracted as follows.

First, 1 part of the toner is added to 40 parts of THF and refluxed for 6 hours, and the insoluble component is precipitated by a centrifugal separator to separate the insoluble component from the supernatant. The insoluble component is dried at 40° C. for 20 hours to obtain THF-insoluble matter. The THF-insoluble matter is a nonlinear polyester resin. Therefore, the THF-insoluble matter contains a plurality of structural portions derived from a trivalent isocyanate.

The composition of the THF-insoluble matter can be analyzed by, for example, solution or solid NMIR (nuclear magnetic resonance), X-ray diffractometry, GC/MS (gas chromatography-mass spectroscopy), LC/MS (liquid chromatography-mass spectroscopy), or TR (infrared spectroscopy).

Conveniently, the composition can be analyzed by a pyrolysis simultaneous methylation GC-MS method using a methylation reaction reagent under the following conditions.

Equipment: QP2010 from Shimadzu Corporation, Py2020D from Frontier Laboratories Ltd.

Data analysis software: GCMS SOLUTION from Shimadzu Corporation

Heating temperature: 280° C.

Reaction pyrolysis temperature: 300° C.

Column name: ULTRA ALLOY-5, L=30 m, ID=0.25 mm, Film=0.25 μm

Thermostatic chamber temperature: 50° C. (holding 1 minute)→10° C./min→330° C. (holding 11 minutes)

Carrier gas: constant at 53.6 kPa, He 1.0 mL/min

Injection mode: Split (1:100)

Ionization method: EI method (70 eV)

Measurement mode: Scan mode Library: NIST 20 MASS SPECTRAL Measurement of Hydroxyl Value and Acid Value The hydroxyl value can be measured based on a method according to JIS K0070-1966 as follows.

First, 0.5 g of a sample is precisely weighed in a 100-mL measuring flask, and 5 mL of an acetylating agent is further put in the flask. The flask is heated in a hot bath at 100±5° C. for 1 to 2 hours. The flask is thereafter taken out from the hot bath and let stand to cool. Water is poured in the flask and the flask is shaken so that acetic anhydride is decomposed.

To completely decompose acetic anhydride, the flask is reheated in the hot bath for 10 minutes or more and thereafter let stand to cool. The wall of the flask is sufficiently washed with an organic solvent. The flask content is subjected to a measurement of hydroxyl value at 23° C. with an automatic potentiometric titrator DL-53 TTTRATOR and electrodes DG113-SC (both available from Mettler-Toledo International Inc.) and an analysis with an analysis software program LabX Light Version 1.00.000. The calibration of the instrument is performed with a mixed solvent of 120 ml of toluene and 30 ml of ethanol under the following condition.

Measurement Conditions
Stir
Speed [%] 25
Time [s] 15
EQP titration
Titrant/Sensor
Titrant CH3ONa
Concentration [mol/L] 0.1
Sensor DG115
Unit of measurement mV
Predispensing to volume
Volume [mL] 1.0
Wait time [s] 0
Titrant addition Dynamic
dE (set) [mV] 8.0
dV (min) [mL] 0.03
dV (max) [mL] 0.5
Measure mode Equilibrium controlled dE [mV] 0.5
dt [s] 1.0
t (min) [s] 2.0
t (max) [s] 20.0
Recognition Threshold 100.0
Steepest jump only No
Range No
Tendency None
Termination
at maximum volume [mL] 10.0
at potential No
at slope No
after number EQPs Yes
n=1
comb. termination conditions No
Evaluation
Procedure Standard
Potential1 No
Potential2 No
Stop for reevaluation No The acid value can be measured based on a method according to JIS K0070-1992 as follows. First, 0.5 g of a sample (or 0.3 g of ethyl-acetate-soluble matter in the sample) is stir-mixed with 120 ml of toluene at 23° C. for about 10 hours to be dissolved in the toluene. Further, 30 ml of ethanol is mixed therein, thus preparing a sample solution. In a case in which the sample is insoluble in toluene, another solvent such as dioxane and tetrahydrofuran may be used.

The flask content is subjected to a measurement of acid value at 23° C. with an automatic potentiometric titrator DL-53 TITRATOR and electrodes DG113-SC (both available from Mettler-Toledo International Inc.) and an analysis with an analysis software program LabX Light Version 1.00.000. The calibration of the instrument is performed with a mixed solvent of 120 ml of toluene and 30 ml of ethanol under the above-described condition for measuring hydroxyl value.

More specifically, the sample solution is titrated with a 0.1N potassium hydroxide/alcohol solution, and the acid value is calculated from the following formula: Acid Value (mgKOH/g)=Titration Amount (mL)×56.1 (mg/mL)/Sample Amount (g), where N represents the factor of the 0.1N potassium hydroxide/alcohol solution.

Measurement of Melting Point and Glass Transition Temperature (Tg)

Melting points and glass transition temperatures (Tg) can be measured with a DSC (differential scanning calorimeter) system (Q-200 available from TA Instruments).

More specifically, melting points and glass transition temperatures (Tg) can be measured in the following manner.

First, about 5.0 mg of a sample is put in an aluminum sample container. The sample container is put on a holder unit and set in an electric furnace. The sample container is heated from −80° C. to 150° C. at a temperature rising rate of 10° C./min ("first heating") in nitrogen atmosphere. The sample container is thereafter cooled from 150° C. to −80° C. at a temperature falling rate of 10° C./min and heated to 150° C. again at a temperature rising rate of 10° C./min ("second heating"). In each of the first heating and the second heating, a DSC curve is obtained by the differential scanning calorimeter (Q-200 available from TA Instruments).

The obtained DSC curves are analyzed with an analysis program installed in Q-200. By selecting the DSC curve obtained in the first heating, a glass transition temperature in the first heating can be determined. Similarly, by selecting the DSC curve obtained in the second heating, a glass transition temperature in the second heating can be determined.

In addition, by selecting the DSC curve obtained in the first heating, an endothermic peak temperature in the first heating can be determined as a melting point in the first heating. Similarly, by selecting the DSC curve obtained in the second heating, an endothermic peak temperature in the second heating can be determined as a melting point in the second heating.

In the present disclosure, Tg1st (toner) and Tg2nd (toner) denote glass transition temperatures measured in the first heating and the second heating, respectively, especially when the sample is a toner.

In the present disclosure, glass transition temperatures and melting points of the toner constituents, such as the amorphous polyester resin, the crystalline polyester resin, and the release agent, are those measured in the second heating, unless otherwise specified.

Measurement of Particle Size Distribution

The volume average particle diameter (D4), number average particle diameter (Dn), and ratio (D4/Dn) therebetween of the toner can be measured by a particle size analyzer such as COULTER COUNTER TA-IT and COULTER MULTISIZER TI (both available from Beckman Coulter, Inc.).

In the present disclosure, a COULTER MULTISIZER II is used.

The measurement method is as follows.

First, 0.1 to 5 mL of a surfactant (preferably a polyoxyethylene alkyl ether (i.e., a nonionic surfactant)), as a dispersant, is added to 100 to 150 ml of an electrolyte solution. Here, the electrolyte solution is a 1% by mass NaCl aqueous solution prepared with the first grade sodium chloride, such as ISOTON-II (available from Beckman Coulter, Inc.). A sample in an amount of from 2 to 20 mg is then added thereto.

The electrolyte solution, in which the sample is suspended, is subjected to a dispersion treatment with an ultrasonic disperser for about 1 to 3 minutes. The electrolyte solution is thereafter subjected to a measurement of the volume and number of toner particles with the above particle size analyzer equipped with a 100-μm aperture, to calculate volume and number distributions.

The volume average particle diameter (D4) and number average particle diameter (Dn) are calculated from the volume and number distributions, respectively, measured above.

Thirteen channels with the following ranges are used for the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Namely, particles having a particle diameter not less than 2.00 μm and less than 40.30 μm are to be measured.

Measurement of Molecular Weight

Molecular weights of toner constituents can be measured under the following conditions.

Gel permeation chromatography (GPC) instrument: HLC-8220 GPC (available from Tohsoh Corporation) Columns: TSKgel SuperHZM-H 15 cm, 3-tandem (available from Tosoh Corporation) Temperature: 40° C. Solvent: Tetrahydrofuran (THF) Flow rate: 0.35 mL/min Sample concentration: 0.15%, Injection amount: 0.4 mL Pretreatment of Sample: A sample (toner or resin) is dissolved in tetrahydrofuran (THF, containing a stabilizer, from Wako Pure Chemical Industries, Ltd.) to prepare a 0.15% by mass THF solution of the sample. The solution is filtered with a 0.2-μm filter, and 100 μL of the filtrate is injected.

The molecular weight of the sample is determined by comparing the molecular weight distribution of the sample with a calibration curve, compiled with several types of monodisperse polystyrene standard samples, that shows the relation between the logarithmic values of molecular weights and the number of counts.

The standard polystyrene samples used to create the calibration curve include SHOWDEX STANDARD Std. No. S-7300, S-210, S-390, S-875, S-1980, S-10.9, S-629, S-3.0, and S-0.580 available from Showa Denko K.K. As the detector, a refractive index (RI) detector is used.

Toner Production Method

A method for producing the toner is not particularly limited and may be appropriately selected according to the purpose. Preferably, the toner is produced by dispersing an oil phase containing the amorphous polyester resin and optionally the other polyester resin, the crystalline polyester resin, the release agent, and the colorant in an aqueous medium.

As an example, the toner may be produced by a dissolution suspension method. As an example thereof, one method is described below which forms mother toner particles while forming a polyester resin having a structure represented by any one of the above structural formulae 1) to 3) by an elongation reaction and/or a cross-linking reaction between the polyester prepolymer and the curing agent. This method involves the processes of preparation of an aqueous medium, preparation of an oil phase containing toner constituents, emulsification or dispersion of the toner constituents, and removal of an organic solvent.

Preparation of Aqueous Medium (Aqueous Phase)

In the aqueous medium, resin particles are dispersed. Preferably, the added amount of the resin particles in the aqueous medium is in the range of from 0.5 to 10 parts by mass based on 100 parts of the aqueous medium.

Specific examples of the aqueous medium include, but are not limited to, water, water-miscible solvents, and mixtures thereof. Each of these aqueous media can be used alone or in combination with others. Among these, water is preferable.

Specific examples of the water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone.

Preparation of Oil Phase

The oil phase may be prepared by dissolving or dispersing toner constituents in an organic solvent, where the toner constituents include at least the non-linear reactive precursor, the amorphous polyester resin B, the crystalline polyester resin C, and the fluorine-modified layered inorganic mineral, and optionally the curing agent, the release agent, and/or the colorant.

Preferably, the organic solvent used for the oil phase is an organic solvent having a boiling point less than 150° C., that is easy to remove, but is not limited thereto.

Specific examples of the organic solvent having a boiling point less than 150° C. include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Each of these solvents can be used alone or in combination with others.

Among these solvents, ethyl acetate, toluene, xylene, benzene, methylene chloride, 1,2-dichloroethane, chloroform, and carbon tetrachloride are preferable, and ethyl acetate is most preferable.

Emulsification or Dispersion

The oil phase containing the toner constituents is emulsified or dispersed in the aqueous medium. At the time the oil phase is emulsified or dispersed, the amorphous polyester resin is formed by an elongation reaction and/or a cross-linking reaction between the curing agent and the polyester prepolymer.

The amorphous polyester resin may be formed by one of the following procedures (1) to (3).

(1) Emulsify or disperse an oil phase containing the polyester prepolymer and the curing agent in an aqueous medium, to cause an elongation reaction and/or a cross-linking reaction between the curing agent and the polyester prepolymer in the aqueous medium.

(2) Emulsify or disperse an oil phase containing the polyester prepolymer in an aqueous medium to which the curing agent has been previously added, to cause an elongation reaction and/or a cross-linking reaction between the curing agent and the polyester prepolymer in the aqueous medium.

(3) Emulsify or disperse an oil phase containing the polyester prepolymer in an aqueous medium and thereafter add the curing agent to the aqueous medium, to cause an elongation reaction and/or a cross-linking reaction between the curing agent and the polyester prepolymer in the aqueous medium from the interfaces of dispersed particles.

The reaction conditions (e.g., reaction time, reaction temperature) for forming the amorphous polyester resin are not limited and determined depending on the combination of the curing agent and the polyester prepolymer.

Preferably, the reaction time is in the range of from 10 minutes to 40 hours, more preferably from 2 to 24 hours, but is not limited thereto.

Preferably, the reaction temperature is in the range of from 0° C. to 150° C., more preferably from 40° C. to 98° C., but is not limited thereto.

A dispersion liquid containing the polyester prepolymer can be reliably prepared by dispersing the oil phase, prepared by dissolving or dispersing the toner constituents in a solvent, in the aqueous medium by application of a shearing force thereto.

Examples of dispersers for dispersing the oil phase include, but are not limited to, low-speed shearing type dispersers, high-speed shearing type dispersers, friction type dispersers, high-pressure jet type dispersers, and ultrasonic dispersers.

Among these dispersers, high-speed shearing type dispersers are preferable because they can adjust the particle diameter of the dispersoids (oil droplets) to 2 to 20 μm.

When a high-speed shearing type disperser is used, dispersing conditions, such as the number of revolution, dispersing time, and dispersing temperature, are determined depending on the purpose.

Preferably, the number of revolution is in the range of from 1,000 to 30,000 rpm, more preferably from 5,000 rpm to 20,000 rpm, but is not limited thereto.

Preferably, the reaction time is in the range of from 0.1 to 5 minutes in the case of batch-type disperser, but is not limited thereto.

Preferably, the amount of the aqueous medium used when the toner constituents are emulsified or dispersed therein is in the range of from 50 to 2,000 parts by mass, more preferably from 100 to 1,000 parts by mass, based on 100 parts by mass of the toner constituents.

When the used amount of the aqueous medium is less than 50 parts by mass, the dispersion state of the toner constituents may degrade and mother toner particles having a desired particle size cannot be obtained. When the used amount of the aqueous medium is in excess of 2,000 parts by mass, manufacturing cost may be increased.

Preferably, when the oil phase containing the toner constituents is emulsified or dispersed in the aqueous medium, a dispersant is used to stabilize dispersoids (oil droplets) to obtain toner particles with a desired shape and a narrow particle size distribution.

Specific examples of the dispersant include, but are not limited to, surfactants, poorly-water-soluble inorganic compounds, and polymeric protection colloids. Each of dispersants can be used alone or in combination with others. Among these, surfactants are preferable.

Examples of the surfactants include, but are not limited to, anionic surfactants, cationic surfactants, nonionic surfactants, and ampholytic surfactants.

Specific examples of the anionic surfactants include, but are not limited to, alkylbenzene sulfonate, α-olefin sulfonate, and phosphate. Among these surfactants, those having a fluoroalkyl group are preferred.

Removal of Organic Solvent

The organic solvent may be removed from the dispersion liquid (emulsion slurry) by, for example, gradually raising the temperature of the reaction system to completely evaporate the organic solvent from oil droplets, or spraying the dispersion liquid into dry atmosphere to completely evaporate the organic solvent from oil droplets.

As the organic solvent has been removed, mother toner particles are isolated. The mother toner particles are washed and dried, and optionally classified by size. The classification may be performed by removing ultrafine particles by cyclone separation, decantation, or centrifugal separation. Alternatively, the classification may be performed after the mother toner particles have been dried.

The mother toner particles may be further mixed with the particulate external additives, charge control agents, etc. By applying a mechanical impact in the mixing, the particulate external additives, etc. are suppressed from releasing from the surface of the mother toner particles.

A mechanical impulsive force can be applied using blades rotating at a high speed, or by accelerating the mother toner particles in a high-speed airflow to allow the toner particles collide with each other or a collision plate.

A mechanical impulsive force can be applied using, for example, ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

Developer

The developer according to an embodiment of the present invention comprises at least the above-described toner and optionally other components such as a carrier.

The developer has excellent transferability and chargeability is capable of reliably forming high-quality image. The developer may be either one-component developer or two-component developer. To be used for high-speed printers corresponding to recent improvement in information processing speed, two-component developer is preferable, because the lifespan of the printer can be extended.

In the case of one-component developer, even when toner supply and toner consumption are repeatedly performed, the particle diameter of the toner fluctuates very little. In addition, neither toner filming on a developing roller nor toner fusing to a layer thickness regulating member (e.g., a blade for forming a thin layer of toner) occurs. Thus, even when the developer is used (stirred) in a developing device for a long period of time, developability and image quality remain good and stable.

In the case of two-component developer, even when toner supply and toner consumption are repeatedly performed for a long period of time, the particle diameter of the toner fluctuates very little. Thus, even when the developer is stirred in a developing device for a long period of time, developability and image quality remain good and stable.

Carrier

The carrier preferably comprises a core material and a resin layer that covers the core material.

Core Material

Specific examples of the core material include, but are not limited to, manganese-strontium materials having a magnetization of from 50 to 90 emu/g and manganese-magnesium materials having a magnetization of from 50 to 90 emu/g. For securing image density, high magnetization materials, such as iron powders having a magnetization of 100 emu/g or more and magnetites having a magnetization of from 75 to 120 emu/g, are preferable. Additionally, low magnetization materials, such as copper-zinc materials having a magnetization of from 30 to 80 emu/g, are preferable for improving image quality, because such materials are capable of reducing the impact of the magnetic brush to a photoconductor.

Each of these materials can be used alone or in combination with others.

The core material preferably has a volume average particle diameter in the range of 10 to 150 μm, more preferably in the range of 40 to 100 μm. When the volume average particle diameter is less than 10 μm, the resulting carrier particles may contain a relatively large amount of fine particles, and therefore the magnetization per carrier particle may be too low to prevent carrier particles from scattering. When the volume average particle diameter is greater than 150 μm, the specific surface area of the carrier particle may be too small to prevent toner particles from scattering. Therefore, solid portions in full-color images may not be reliably reproduced.

The two-component developer can be prepared by mixing the above toner with a carrier. The content of the carrier in the two-component developer is preferably from 90 to 98 parts by weight, more preferably from 93 to 97 parts by weight, based on 100 parts by weight of the two-component developer.

The developer can be used for image forming methods employing electrophotographic methods such as magnetic one-component developing method, non-magnetic one-component developing method, and two-component developing method.

In the present disclosure, a toner storage unit refers to a unit that has a function of storing toner and that is storing the above toner. The toner storage unit may be in the form of, for example, a toner storage container, a developing device, or a process cartridge.

In the present disclosure, the toner storage container refers to a container storing the toner.

The developing device refers to a device storing the toner and having a developing unit configured to develop an electrostatic latent image into a toner image with the toner.

The process cartridge refers to a combined body of an image bearer with a developing unit storing the toner, detachably mountable on an image forming apparatus. The process cartridge may further include at least one of a charger, an irradiator, and a cleaner.

An image forming apparatus to which the toner storage unit is attached can perform image forming operation utilizing the above toner that does not cause filming and provides excellent low-temperature fixability, high-temperature offset resistance, high gloss, high color reproducibility, and heat-resistant storage stability.

In the following, a developer storage container that accommodates a developer including the toner will be described.

Developer Storage Container

A developer storage container according to an embodiment of the present invention contains a developer according to an embodiment of the present invention and has no particular limitation. The storage container may include a container body and a cap.

The container body is not limited in size, shape, structure, and material. Preferably, the container body has a cylindrical shape. Preferably, on the inner circumferential surface of the container body, projections and recesses are formed in a spiral manner, so that the developer can move to the discharge port side as the container body rotates. More preferably, part or all of the projections and recesses formed in a spiral manner have an accordion function. The container body is preferably made of a resin material having good dimension accuracy, such as polyester resin, polyethylene resin, polypropylene resin, polystyrene resin, polyvinyl chloride resin, polyacrylic acid, polycarbonate resin, ABS resin, and polyacetal resin.

The developer storage container is easy to preserve, transport, and handle. Therefore, the developer storage container is detachably mountable on a process cartridge or an image forming apparatus (to be described later) to supply the developer thereto.

Image Forming Apparatus and Image Forming Method

An image forming apparatus in accordance with some embodiments of the present invention includes at least an electrostatic latent image bearer, an electrostatic latent image forming device, and a developing device, and optionally other members.

An image forming method in accordance with some embodiments of the present invention includes at least a charging process, an irradiation process, a developing process, a primary transfer process, a secondary transfer process, a fixing process, and a cleaning process, and optionally other processes.

The image forming method is preferably performed by the image forming apparatus. The charging process and the irradiation process are preferably performed by the electrostatic latent image forming device. The developing process is preferably performed by the developing device. Other optional processes are preferably performed by other optional members.

Electrostatic Latent Image Bearer

The electrostatic latent image bearer is not limited in material, structure, and size. Specific examples of usable materials include, but are not limited to, inorganic photoconductors such as amorphous silicon and selenium, and organic photoconductors such as polysilane and phthalopolymethine. Among these materials, amorphous silicon is preferable for long operating life.

An amorphous silicon photoconductor can be prepared by, for example, heating a substrate to 50° C. to 400° C. and forming a photoconductive layer comprising amorphous silicon on the substrate by means of vacuum evaporation, sputtering, ion plating, thermal CVD (Chemical Vapor Deposition), optical CVD, or plasma CVD. In particular, plasma CVD, which forms an amorphous silicon film on the substrate by decomposing a raw material gas by direct-current, high-frequency, or micro-wave glow discharge, is preferable.

The electrostatic latent image bearer is not limited in shape but preferably in the form of a cylinder. The electrostatic latent image bearer in the form of a cylinder preferably has an outer diameter of from 3 to 100 mm, more preferably from 5 to 50 mm, and most preferably from 10 to 30 mm.

Electrostatic Latent Image Forming Device and Electrostatic Latent Image Forming Process The electrostatic latent image forming device has no limit so long as it can form an electrostatic latent image on the electrostatic latent image bearer. For example, the electrostatic latent image forming device may include a charger to uniformly charge a surface of the electrostatic latent image bearer and an irradiator to irradiate the surface of the electrostatic latent image bearer with light containing image information.

The electrostatic latent image forming process has no limit so long as an electrostatic latent image can be formed on the electrostatic latent image bearer. For example, the electrostatic latent image forming process may include charging a surface of the electrostatic latent image bearing member and irradiating the surface with light containing image information. The electrostatic latent image forming process can be performed by the electrostatic latent image forming device.

Charger and Charging Process

Specific examples of the charger include, but are not limited to, contact chargers equipped with a conductive or semiconductive roller, brush, film, or rubber blade, and non-contact chargers employing corona discharge such as corotron and scorotron.

The charging process may include applying a voltage to a surface of the electrostatic latent image bearer by the charger.

The shape of the charger is determined in accordance with the specification or configuration of the image forming apparatus, and may be in the form of a roller, a magnetic brush, a fur brush, etc.

The charger is not limited to the contact charger. However, the contact charger is preferable because it can reduce the amount of by-product ozone.

Irradiator and Irradiation Process

The irradiator has no limit so long as it can emit light containing image information to the surface of the electrostatic latent image bearer charged by the charger. Specific examples of the irradiator include, but are not limited to, various irradiators of radiation optical system type, rod lens array type, laser optical type, and liquid crystal shutter optical type.

Specific examples of light sources for use in the irradiator include, but are not limited to, luminescent matters such as fluorescent lamp, tungsten lamp, halogen lamp, mercury lamp, sodium lamp, light emitting diode (LED), laser diode (LD), and electroluminescence (EL).

For the purpose of emitting light having a desired wavelength only, any type of filter can be used, such as sharp cut filter, band pass filter, near infrared cut filter, dichroic filter, interference filter, and color-temperature conversion filter.

The irradiation process may include irradiating the surface of the electrostatic latent image bearer with light containing image information emitted from the irradiator.

The irradiation can also be conducted by irradiating the back surface of the electrostatic latent image bearer with light containing image information.

Developing Device and Developing Process

The developing device has no limit so long as it can store a toner and develop the electrostatic latent image formed on the electrostatic latent image bearer into a visible image with the toner.

The developing process has no limit so long as the electrostatic latent image formed on the electrostatic latent image bearer can be developed into a visible image with a toner. The developing process may be performed by the developing device.

The developing device may employ either a dry developing method or a wet developing method. The developing device may be either a single-color developing device or a multi-color developing device.

Preferably, the developing device includes a stirrer to frictionally stir and charge the toner, a magnetic field generator fixed inside the developing device, and a rotatable developer bearer to bear a developer containing the toner on its surface.

In the developing device, toner particles and carrier particles are mixed and agitated. The toner particles are charged by friction and retained on the surface of the rotating magnet roller, thus forming magnetic brush. The magnet roller is disposed adjacent to the electrostatic latent image bearer. Therefore, a part of the toner particles composing the magnetic brush formed on the surface of the magnet roller are moved to the surface of the electrostatic latent image bearer by electric attractive force. As a result, the electrostatic latent image is developed with the toner particles and a visible image is formed with the toner particles on the surface of the electrostatic latent image bearer.

Other Devices and Other Processes

Examples of the other optional devices include, but are not limited to, a transfer device, a fixing device, a cleaner, a neutralizer, a recycler, and a controller.

Examples of the other optional processes include, but are not limited to, a transfer process, a fixing process, a cleaning process, a neutralization process, a recycle process, and a control process.

Transfer Device and Transfer Process

The transfer device has no limit so long as it can transfer the visible image onto a recording medium. Preferably, the transfer device includes a primary transfer device to transfer the visible image onto an intermediate transfer medium to form a composite transfer image, and a secondary transfer device to transfer the composite transfer image onto a recording medium.

The transfer process has no limit so long as the visible image can be transferred onto a recording medium. Preferably, the transfer process includes primarily transferring the visible image onto an intermediate transfer medium and secondarily transferring the visible image onto a recording medium.

In the transfer process, the visible image may be transferred by charging the electrostatic latent image bearer by a transfer charger. The transfer process can be performed by the transfer device.

When the image to be secondarily transferred onto the recording medium is a color image formed of multiple toners having different colors, each color toner is sequentially superimposed on one another on the intermediate transfer medium to form a composite image thereon, and then the composite image on the intermediate transfer medium is secondarily transferred onto the recording medium.

Specific preferred examples of the intermediate transfer medium include, but are not limited to, a transfer belt.

The linear velocity of transfer of the toner image onto the recording medium (recording material) is from 100 to 1,000 mm/sec, and the transfer time at the nip portion of the secondary transfer device is preferably from 0.5 to 60 msec. By satisfying these requirements, both productivity (printing efficiency) and transferability can be achieved.

The transfer device (including the primary transfer device and the secondary transfer device) preferably includes a transferrer configured to separate the visible image formed on the electrostatic latent image bearer to the recording medium side by charging. Specific examples of the transferrer include, but are not limited to, corona transferrer utilizing corona discharge, transfer belt, transfer roller, pressure transfer roller, and adhesive transferrer.

Although the recording medium is typically plain paper, it is not particularly limited as long as it can transfer an unfixed image after development and can be appropriately selected according to the purpose. For example, PET bases for use in overhead projector (OHP) can also be used.

Fixing Device and Fixing Process

The fixing device has no limit so long as it can fix the transferred visible image on the recording medium. Preferably, the fixing device includes a heat-pressure member. Specific examples of the heat-pressure member include, but are not limited to: a combination of a heat roller and a pressure roller; and a combination of a heat roller, a pressure roller, and an endless belt.

The fixing process has no limit so long as the visible image transferred onto the recording medium can be fixed thereon. The fixing process may be performed either every time each color toner is transferred onto the recording medium or at once after all color toners are superimposed on one another.

The fixing process may be performed by the fixing device.

The heating temperature of the heat-pressure member is preferably from 80 to 200° C.

The fixing device may be used together with or replaced with an optical fixer according to the purpose.

In the fixing process, the fixing pressure is preferably from 10 to 80 N/cm$^2$, but is not limited thereto.

Cleaner and Cleaning Process

The cleaner is not particularly limited so long as it removes residual toner particles remaining on the electrostatic latent image bearer. Specific examples of the cleaner include, but are not limited to, magnetic brush cleaner, electrostatic brush cleaner, magnetic roller cleaner, blade cleaner, brush cleaner, and web cleaner.

The cleaning process is a process in which residual toner particles remaining on the electrostatic latent image bearer are removed. The cleaning process can be performed by the cleaner.

Neutralizer and Neutralization Process

The neutralizer is not particularly limited so long as it neutralizes the electrostatic latent image bearer by applying a neutralization bias thereto. Specific examples of the neutralizer include, but are not limited to, neutralization lamp.

The neutralization process is a process in which the electrostatic latent image bearer is neutralized by being applied with a neutralization bias. The neutralization process can be performed by the neutralizer.

Recycler and Recycle Process

The recycler is not particularly limited so long as it makes the developing device recycle the toner removed in the cleaning process. Specific examples of the recycler include, but are not limited to, conveyer.

The recycle process is a process in which the toner particles removed in the cleaning process are recycled by the developing device. The recycle process can be performed by the recycler.

Controller and Control Process

The controller is not particularly limited so long as it controls the above-described processes. Specific examples of the controller include, but are not limited to, sequencer and computer.

The control process is a process in which the above-descried processes are controlled. The control process can be performed by the controller.

An image forming apparatus in accordance with some embodiments of the present invention is described below with reference to FIG. 3. A full-color image forming apparatus 100A illustrated in FIG. 3 includes a photoconductor drum 10 (hereinafter "photoconductor 10" or "electrostatic latent image bearer 10") serving as the electrostatic latent image bearer, a charging roller 20 serving as the charger, an irradiator 30 serving as the irradiator, a developing device 40 serving as the developing device, an intermediate transfer medium 50, a cleaner 60 equipped with a cleaning blade serving as the cleaner, and a neutralization lamp 70 serving as the neutralizer.

The intermediate transfer medium 50 is in the form of an endless belt and is stretched taut by three rollers 51 disposed inside the loop of the endless belt. The intermediate transfer medium 50 is movable in the direction indicated by arrow in FIG. 3. One or two of the three rollers 51 also function(s) as transfer bias roller(s) for applying a predetermined transfer bias (primary transfer bias) to the intermediate transfer medium 50. In the vicinity of the intermediate transfer medium 50, a cleaner 90 equipped with a cleaning blade is disposed. In the vicinity of the intermediate transfer medium 50, a transfer roller 80, serving as the transfer device, that applies a transfer bias to a transfer sheet 95, serving as a recording medium, for secondarily transferring a toner image thereon is disposed facing the intermediate transfer medium 50. Around the intermediate transfer medium 50, a corona charger 58 that gives charge to the toner image on the intermediate transfer medium 50 is disposed between the contact point of the intermediate transfer medium 50 with the photoconductor 10 and the contact point of the intermediate transfer medium 50 with the transfer sheet 95 relative to the direction of rotation of the intermediate transfer medium 50.

The developing device 40 includes a developing belt 41 serving as the developer bearer; and a black developing unit 45K, a yellow developing unit 45Y, a magenta developing unit 45M, and a cyan developing unit 45C each disposed around the developing belt 41. The black developing unit 45K includes a developer container 42K, a developer supply roller 43K, and a developing roller 44K. The yellow developing unit 45Y includes a developer container 42Y, a developer supply roller 43Y, and a developing roller 44Y. The magenta developing unit 45M includes a developer container 42M, a developer supply roller 43M, and a developing roller 44M. The cyan developing unit 45C includes a developer container 42C, a developer supply roller 43C, and a developing roller 44C. The developing belt 41 is in the form of an endless belt and stretched taut by multiple belt rollers. A part of the developing belt 41 is in contact with the photoconductor 10.

Figure 3:
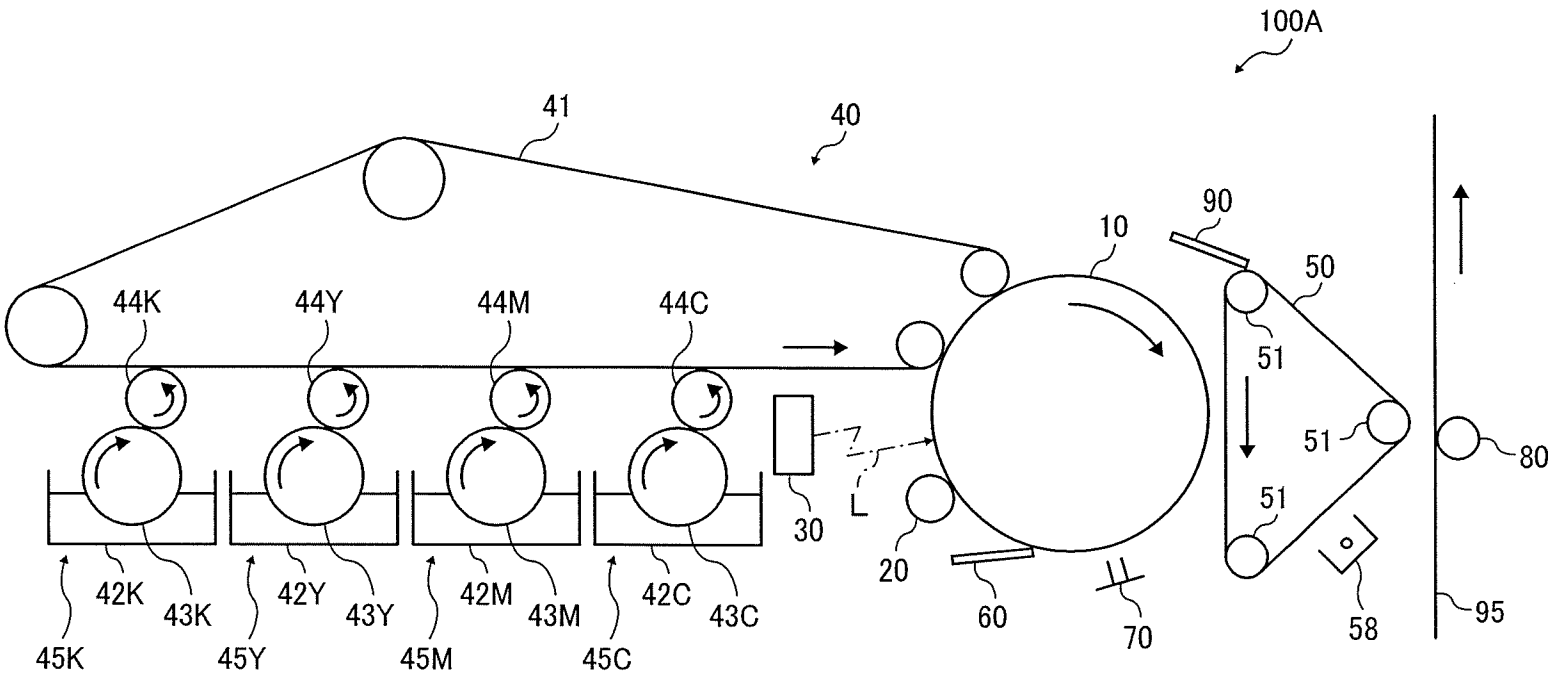
FIG. 3 is a schematic view of an image forming apparatus according to an embodiment of the present invention.

In the image forming apparatus 100A illustrated in FIG. 3, the charging roller 20 uniformly charges the photoconductor drum 10. The irradiator 30 irradiates the photoconductor drum 10 with light L containing image information to form an electrostatic latent image thereon. The developing device 40 supplies toner to the electrostatic latent image formed on the photoconductor drum 10 to form a toner image. The toner image is primarily transferred onto the intermediate transfer medium 50 by a voltage applied from the roller 51 and secondarily transferred onto the transfer sheet 95. Thus, a transfer image is formed on the transfer sheet 95. Residual toner particles remaining on the photoconductor 10 are removed by the cleaner 60. The charge of the photoconductor 10 is once eliminated by the neutralization lamp 70.

Figure 4:
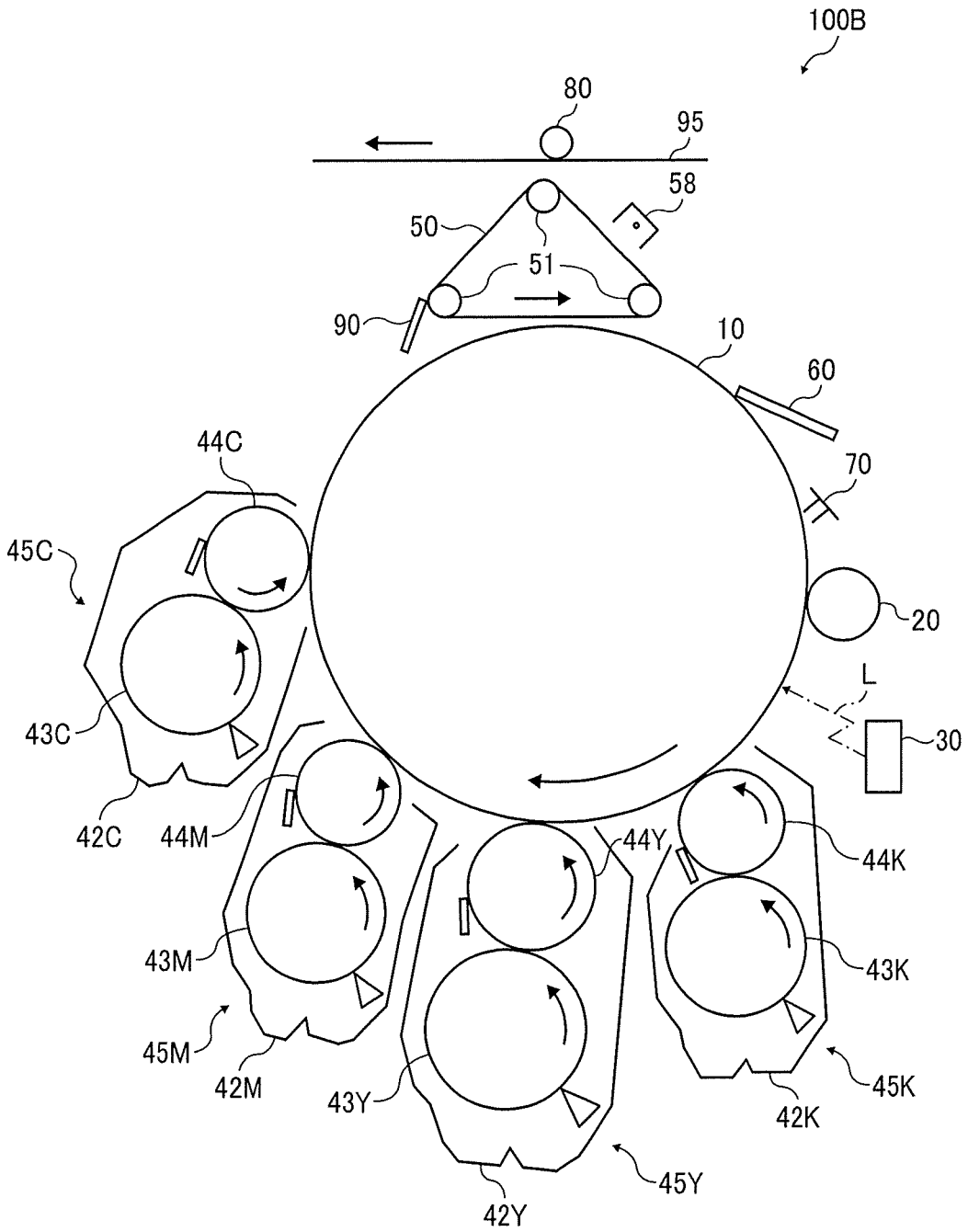
FIG. 4 is a schematic view of an image forming apparatus according to an embodiment.

FIG. 4 is a schematic view of an image forming apparatus according to another embodiment of the invention. An image forming apparatus 100B has a similar configuration to the image forming apparatus 100A illustrated in FIG. 3 except that the developing belt 41 is omitted and the black developing unit 45K, the yellow developing unit 45Y, the magenta developing unit 45M, and the cyan developing unit 45C are disposed facing the circumferential surface of the photoconductor 10.

Figure 5:
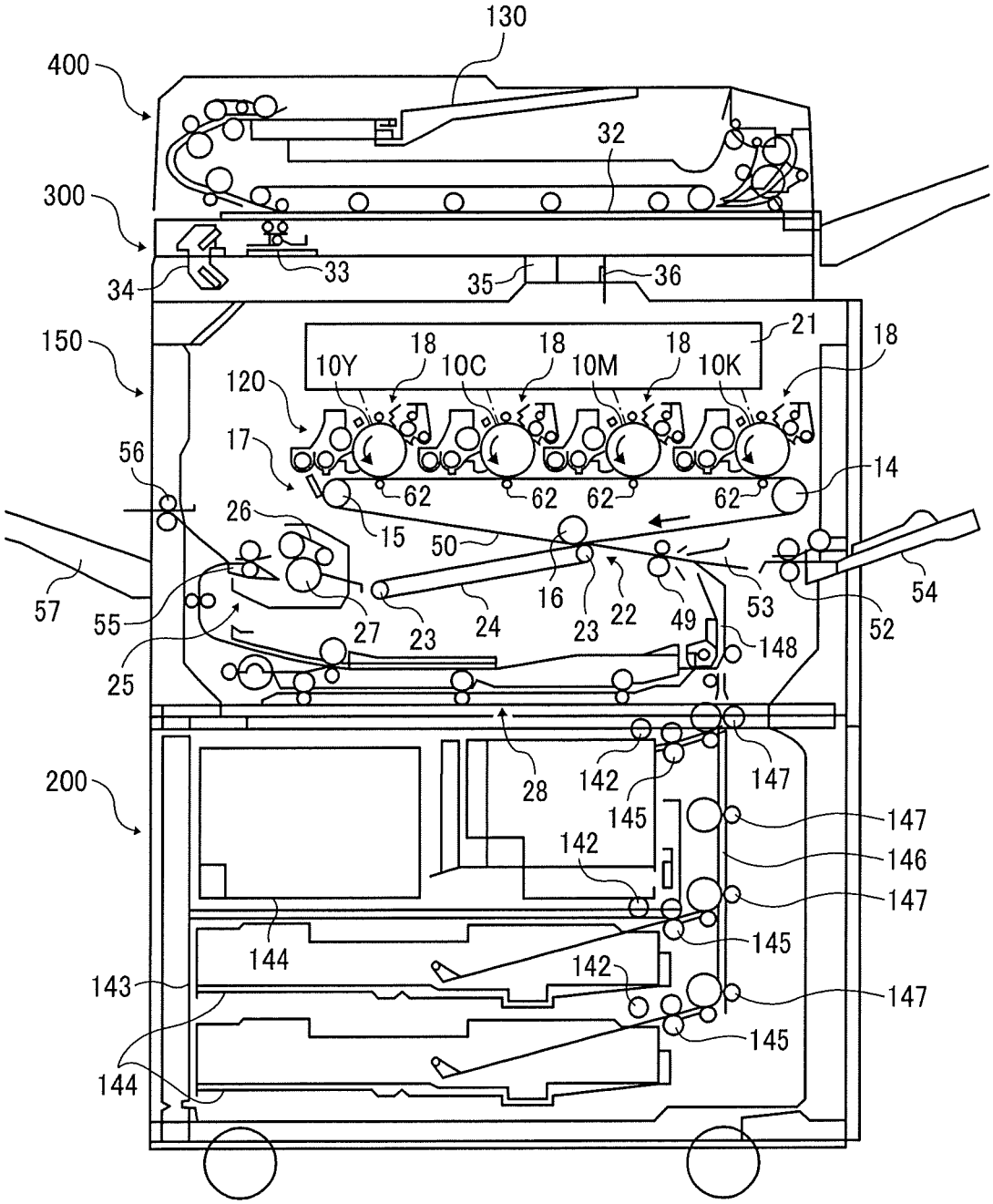
FIG. 5 is a schematic view of an image forming apparatus according to an embodiment.

FIG. 5 is a schematic view of an image forming apparatus according to an embodiment of the present invention. An image forming apparatus illustrated in FIG. 5 includes a copier main body 150, a sheet feeding table 200, a scanner 300, and an automatic document feeder (ADF) 400.

In the central part of the copier main body 150, an intermediate transfer medium 50 in the form of an endless belt is disposed. The intermediate transfer medium 50 is stretched taut with support rollers 14, 15, and 16 and rotatable clockwise in FIG. 5. In the vicinity of the support roller 15, an intermediate transfer medium cleaner 17 for removing residual toner particles remaining on the intermediate transfer medium 50 is disposed. Four image forming units 18 for respectively forming yellow, cyan, magenta, and black images are arranged in tandem facing a part of the intermediate transfer medium 50 stretched between the support rollers 14 and 15 in the direction of conveyance of the intermediate transfer medium 50, thus forming a tandem developing device 120. In the vicinity of the tandem developing device 120, an irradiator 21 serving as the irradiator is disposed. On the opposite side of the tandem developing device 120 relative to the intermediate transfer medium 50, a secondary transfer device 22 is disposed. The secondary transfer device 22 includes a secondary transfer belt 24 in the form of an endless belt stretched taut with a pair of rollers 23. A transfer sheet conveyed on the secondary transfer belt 24 can contact with the intermediate transfer medium 50. In the vicinity of the secondary transfer device 22, a fixing device 25 serving as the fixing device is disposed. The fixing device 25 includes a fixing belt 26 in the form of an endless belt and a pressing roller 27 pressed against the fixing belt 26.

In the vicinity of the secondary transfer device 22 and the fixing device 25, a sheet reversing device 28 is disposed for reversing the transfer sheet so that images can be formed on both surfaces of the transfer sheet.

A full-color image forming (color copying) operation performed using the tandem developing device 120 is described below. First, a document is set on a document table 130 of the automatic document feeder 400. Alternatively, a document is set on a contact glass 32 of the scanner 300 while the automatic document feeder 400 is lifted up, followed by holding down of the automatic document feeder 400.

As a start switch is pressed, in a case in which a document is set to the automatic document feeder 400, the scanner 300 starts driving after the document is moved onto the contact glass 32; and in a case in which a document is set on the contact glass 32, the scanner 300 immediately starts driving. A first traveling body 33 and a second traveling body 34 thereafter start traveling. The first traveling body 33 directs light emitted from a light source to the document. A mirror carried by the second traveling body 34 reflects light reflected from the document containing a color image toward a reading sensor 36 through an imaging lens 35. Thus, the document is read by the reading sensor 36 and converted into image information of yellow, cyan, magenta, and black.

Figure 6:
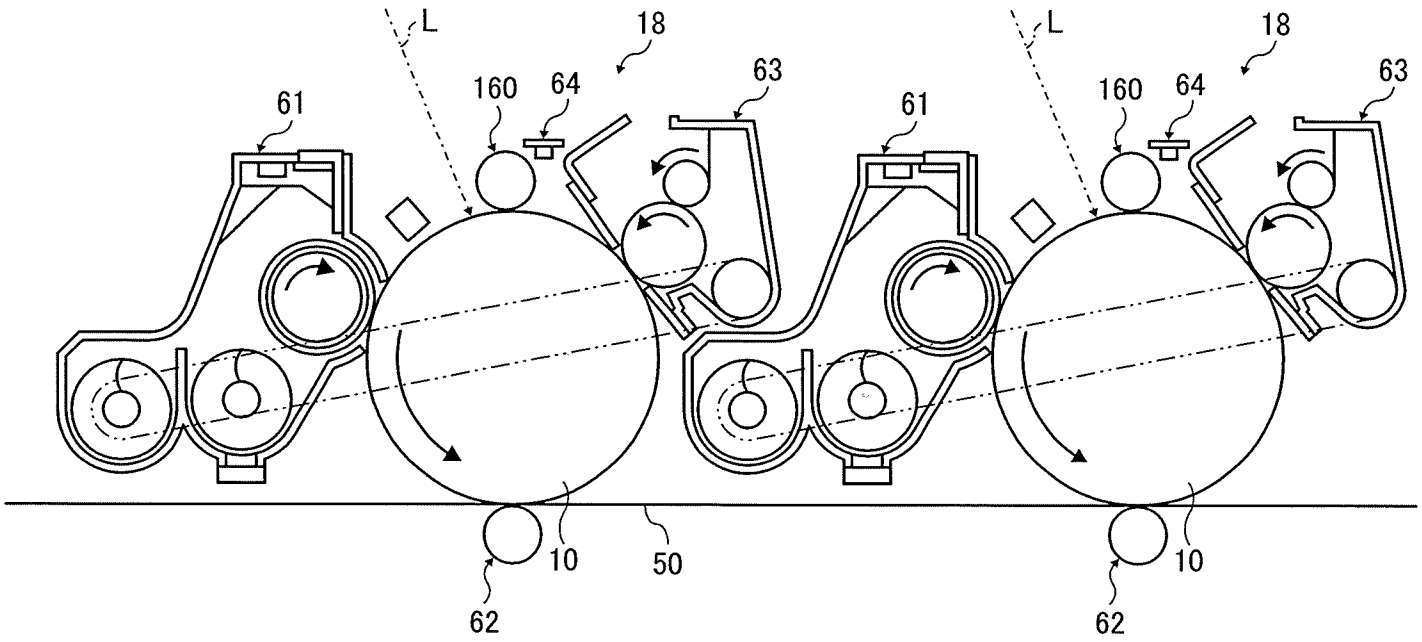
FIG. 6 is a partial magnified view of FIG. 5.

The image information of yellow, cyan, magenta, and black are respectively transmitted to the respective image forming units 18 (i.e., yellow image forming device, cyan image forming device, magenta image forming device, and black image forming device) included in the tandem developing device 120. The image forming units 18 form respective toner images of yellow, cyan, magenta, and black. As illustrated in FIG. 6, each of the image forming units 18 (i.e., yellow image forming device, cyan image forming device, magenta image forming device, or black image forming device) in the tandem developing device 120 includes: an electrostatic latent image bearer 10 (i.e., electrostatic latent image bearers 10Y, 10C, 10M, or 10K); a charger 160 to uniformly charge the electrostatic latent image bearer 10; a developing device 61 to develop the electrostatic latent image with respective toner (i.e., yellow toner, cyan toner, magenta toner, or black toner) to form a toner image; a transfer charger 62 to transfer the toner image onto the intermediate transfer medium 50, a cleaner 63, and a neutralizer 64. Each image forming unit 18 forms a single-color toner image (i.e., yellow toner image, cyan toner image, magenta toner image, or black toner image) based on the image information of each color. The toner images of yellow, cyan, magenta, and black formed on the respective electrostatic latent image bearers 10Y, 10C, 10M, and 10K are primarily transferred in a sequential manner onto the intermediate transfer medium 50 that is rotated by the support rollers 14, 15, and 16. The toner images of yellow, cyan, magenta, and black are superimposed on one another on the intermediate transfer medium 50, thus forming a composite full-color toner image.

At the same time, in the sheet feeding table 200, one of sheet feeding rollers 142 starts rotating to feed recording sheets from one of sheet feeding cassettes 144 in a sheet bank 143. One of separation rollers 145 separates the sheets one by one and feeds them to a sheet feeding path 146. Feed rollers 147 feed each sheet to a sheet feeding path 148 in the copier main body 150. The sheet is stopped upon striking a registration roller 49. Alternatively, sheets may be fed from a manual feed tray 54. In this case, a separation roller 52 separates the sheets one by one and feeds it to a manual sheet feeding path 53. The sheet is stopped upon striking the registration roller 49. The registration roller 49 is generally grounded. Alternatively, the registration roller 49 may be applied with a bias for the purpose of removing paper powders from the sheet. The registration roller 49 starts rotating to feed the sheet to between the intermediate transfer medium 50 and the secondary transfer device 22 in synchronization with an entry of the composite full-color toner image formed on the intermediate transfer medium 50 thereto. The secondary transfer device 22 secondarily transfers the composite full-color toner image onto the sheet. Thus, the composite full-color image is formed on the sheet. After the composite full-color image is transferred, residual toner particles remaining on the intermediate transfer medium 50 are removed by the intermediate transfer medium cleaner 17.

The sheet having the composite full-color toner image thereon is fed from the secondary transfer device 22 to the fixing device 25. The fixing device 25 fixes the composite full-color toner image on the sheet by application of heat and pressure. A switch claw 55 switches sheet feeding paths so that the sheet is ejected by an ejection roller 56 and stacked on a sheet ejection tray 57. Alternatively, the switch claw 55 may switch sheet feed paths so that the sheet is introduced into the sheet reversing device 28 and gets reversed. The sheet is then introduced to the transfer position again so that another image is recorded on the back side of the sheet. Thereafter, the sheet is ejected by the ejection roller 56 and stacked on the sheet ejection tray 57.

Process Cartridge

A process cartridge in accordance with some embodiments of the present invention includes at least an electrostatic latent image bearer to bear an electrostatic latent image and a developing device to develop the electrostatic latent image into a toner image with the toner in accordance with some embodiments of the present invention. The process cartridge is configured to be detachably mountable on an image forming apparatus. The process cartridge may further include other members, if necessary.

The developing device includes a developer storage container containing the developer in accordance with some embodiments of the present invention, and a developer bearer to bear and convey the developer contained in the developer storage container. The developing device may further include a regulator to regulate the thickness of the developer layer borne on the developer bearer.

Figure 7:
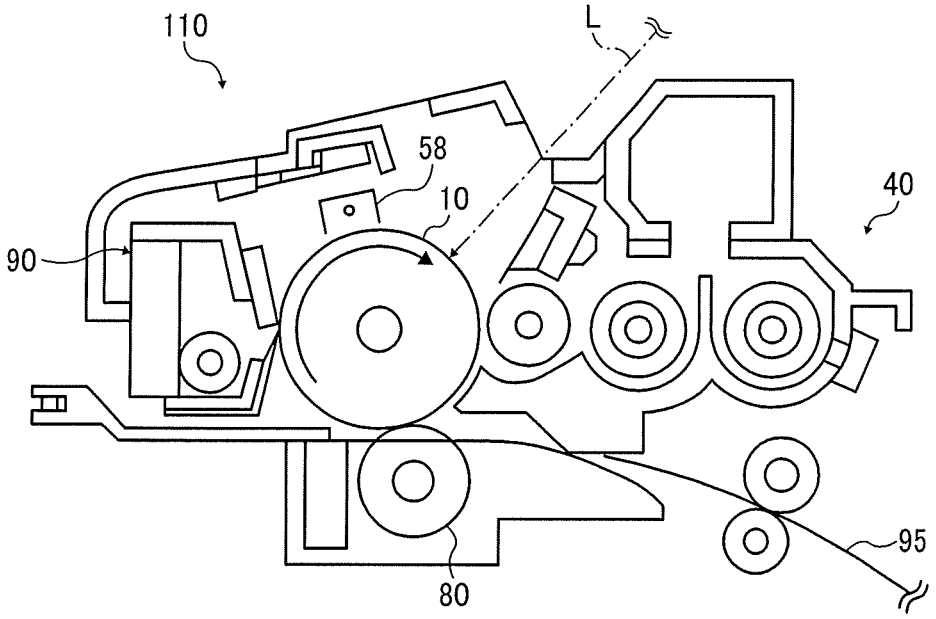
FIG. 7 is a schematic view of a process cartridge according to an embodiment of the present invention.

FIG. 7 is a schematic view of a process cartridge according to an embodiment of the present invention. A process cartridge 110 includes a photoconductor drum 10, a corona charger 58, a developing device 40, a transfer roller 80, and a cleaner 90. Reference numeral 95 denotes transfer paper, and L denotes exposure light.

EXAMPLES

The embodiments of the present invention is further described in detail with reference to the Examples but is not limited to the following Examples. In the following descriptions, "parts" represents parts by mass and "% (percent)" represents percent by mass unless otherwise specified.

Each measurement value in the following examples was measured by the method described in this specification. Properties (e.g., Tg and molecular weight) of the amorphous polyester resin, the crystalline polyester resin, etc., were measured from the single bodies thereof.

Production Example 1

Synthesis of Ketimine

In a reaction vessel equipped with a stirrer and a thermometer, 170 parts of isophoronediamine and 75 parts of methyl ethyl ketone were contained and allowed to react at 50° C. for 5 hours. Thus, a ketimine compound 1 was prepared.

The ketimine compound 1 had an amine value of 418.

Production Example A

Synthesis of Amorphous Polyester Resin A

Synthesis of Prepolymer A

A reaction vessel equipped with a cooling tube, a stirrer, and a nitrogen introducing tube was charged with diol components comprising 100% by mol of 3-methyl-1,5-pentanediol and dicarboxylic acid components comprising 50% by mol of terephthalic acid and 50% by mol of adipic acid, along with 1,000 ppm (based on the resin components) of titanium tetraisopropoxide, such that the molar ratio (OH/COOH) of hydroxyl groups to carboxyl groups became 1.2.

The vessel contents were heated to 200° C. over a period of about 4 hours, thereafter heated to 230° C. over a period of 2 hours, and the reaction was continued until outflow water was no more produced.

The vessel contents were further allowed to react under reduced pressures of from 10 to 15 mmHg for 5 hours. Thus, an intermediate polyester A' was prepared.

The intermediate polyester A' had a Tg of −40° C., an Mw of 15,000, and a ratio Mw/Mn of 2.0.

Next, in a reaction vessel equipped with a cooling tube, a stirrer, and a nitrogen introducing tube, the intermediate polyester A' and trimer of hexamethylene diisocyanate (HDI) were contained such that the molar ratio of isocyanate groups in HDI to hydroxyl groups in the intermediate polyester became 0.2. The vessel contents were diluted with ethyl acetate to become a 50% ethyl acetate solution and further allowed to react at 100° C. for 5 hours. Thus, a solution of an intermediate polyester A was prepared.

The intermediate polyester A had a Tg of −35° C., an Mw of 20,000, and a ratio Mw/Mn of 2.2.

Next, in a reaction vessel equipped with a cooling tube, a stirrer, and a nitrogen introducing tube, the solution of the intermediate polyester A and isophorone diisocyanate (IPDI) were contained such that the molar ratio of isocyanate groups in IPDI to hydroxyl groups in the intermediate polyester became 1.5. The vessel contents were diluted with ethyl acetate to become a 50% ethyl acetate solution and further allowed to react at 100° C. for 5 hours. Thus, a solution of a prepolymer A was prepared.

Synthesis of Amorphous Polyester Resin A

The above-prepared prepolymer A was stirred in a reaction vessel equipped with a heater, a stirrer, and a nitrogen introducing tube. Furthermore, the ketimine compound 1 was dropped in the reaction vessel, such that the amount of amine in the ketimine compound 1 became equimolar with the amount of isocyanate in the prepolymer A, and stirred at 45° C. for 10 hours. Thus, a prepolymer elongated product was obtained.

The prepolymer elongated product was dried at 50° C. under reduced pressures until the residual amount of ethyl acetate became 100 ppm or less. Thus, an amorphous polyester resin A was prepared.

The amorphous polyester resin A had a Tg of −25° C.

Production Example B

Synthesis of Amorphous Polyester Resin B

Synthesis of Prepolymer B

A four-neck flask equipped with a nitrogen inlet pipe, a dewatering pipe, a stirrer, and a thermocouple was charged with a mixture of ethylene oxide 2 mol adduct of bisphenol A with propylene oxide 3 mol adduct of bisphenol A at a molar ratio of 85/15, another mixture of isophthalic acid with adipic acid at a molar ratio of 80/20, and trimellitic anhydride, such that the ratio (OH/COOH) of hydroxyl groups carboxyl groups became 1.4. The flask contents were allowed to react in the presence of 500 ppm of titanium tetraisopropoxide for 8 hours at 230° C. under normal pressure and subsequent 4 hours reduced pressures of from 10 to 15 mmHg. Thus, an intermediate polyester B was prepared.

Next, in a reaction vessel equipped with a cooling tube, a stirrer, and a nitrogen introducing tube, the solution of the intermediate polyester B and isophorone diisocyanate (IPDI) were contained such that the molar ratio of isocyanate groups in IPDI to hydroxyl groups in the intermediate polyester became 1.5. The vessel contents were diluted with ethyl acetate to become a 50% ethyl acetate solution and further allowed to react at 100° C. for 5 hours. Thus, a solution of a prepolymer B was prepared.

Synthesis of Amorphous Polyester Resin B

The above-prepared prepolymer B was stirred in a reaction vessel equipped with a heater, a stirrer, and a nitrogen introducing tube. Furthermore, the ketimine compound 1 was dropped in the reaction vessel such that the amount of amine in the ketimine compound 1 became equimolar with the amount of isocyanate in the prepolymer B and stirred at 45° C. for 10 hours. Thus, a prepolymer elongated product was obtained.

The prepolymer elongated product was dried at 50° C. under reduced pressures until the residual amount of ethyl acetate became 100 ppm or less. Thus, an amorphous polyester resin B was prepared.

The amorphous polyester resin B had a Tg of 45° C.

Production Example C

Synthesis of Crystalline Polyester Resin C

A 5-L four-neck flask equipped with a nitrogen inlet tube, a dewatering tube, a stirrer, and a thermocouple, dodecanedioic acid and 1,6-hexanediol were contained such that the molar ratio (OH/COOH) of hydroxyl groups to carboxyl groups became 0.9. After adding 500 ppm (based on the resin components) of titanium tetraisopropoxide to the flask, the flask contents were allowed to react at 180° C. for 10 hours, thereafter at 200° C. for 3 hours, and further under a pressure of 8.3 kPa for 2 hours. Thus, a crystalline polyester resin C was prepared.

Production Example D

Synthesis of Polyester Resin D-1

In a four-neck flask equipped with a nitrogen inlet tube, a dewatering tube, a stirrer, and a thermocouple, alcohol components including ethylene oxide 2-mol adduct of bisphenol A (BisA-EO), propylene oxide 3-mol adduct of bisphenol A (BisA-PO), and trimethylolpropane (TMP) at a molar ratio (BisA-EO/BisA-PO/TMP) of 38.6/57.9/3.5 and acid components including terephthalic acid and adipic acid at a molar ratio (terephthalic acid/adipic acid) of 85/15 were contained, such that the molar ratio (OH/COOH) of hydroxy groups to carboxyl groups became 1.12. After adding 500 ppm of titanium tetraisopropoxide (based on the resin components) to the flask, the flask contents were allowed to react at 230° C. at normal pressures for 8 hours, and subsequently at reduced pressures of 10 to 15 mmHg for 4 hours. After further adding 1% by mol of trimellitic anhydride (based on all the resin components) to the flask, the flask contents were allowed to react at 180° C. at normal pressures for 3 hours. Thus, a polyester resin D-1 was prepared.

Synthesis of Polyester Resins D-2 and D-3

Polyester resins D-2 and D-3 each were obtained in the same manner as the polyester resin D-1 except that the acid components and the alcohol components were changed as presented in Table 1-1.

Preparation of Master Batch

First, 1,200 parts of water, 500 parts of a carbon black (PRINTEX 35 available from Degussa, having a DBP oil absorption of 42 mL/100 mg and a pH of 9.5), and 500 parts of the polyester resin D-1 were mixed with a HENSCHEL MIXER (manufactured Mitsui Mining and Smelting Co., Ltd.). The mixture was kneaded with a double roll at 150° C. for 30 minutes, thereafter rolled to cool, and pulverized with a pulverizer. Thus, a master batch 1 was prepared.

Preparation of Wax Dispersion Liquid

In a vessel equipped with a stirrer and a thermometer, 50 parts of a paraffin wax (HNP-9 available from NIPPON SEIRO CO., LTD., a hydrocarbon wax having a melting point of 75° C. and a solubility parameter (SP) of 8.8), serving as a release agent 1 and 450 parts of ethyl acetate were contained and heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation was repeated 3 times (3 passes). Thus, a wax dispersion liquid 1 was prepared.

Preparation of Crystalline Polyester Resin Dispersion Liquid

In a vessel equipped with a stirrer and a thermometer, 50 parts of the crystalline polyester resin C and 450 parts of ethyl acetate were contained and heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a crystalline polyester resin dispersion liquid 1 was prepared.

Example 1

Preparation of Oil Phase

In a vessel, 500 parts of the wax dispersion liquid 1, 300 parts of the prepolymer A, 900 parts of the prepolymer B, 350 parts of the crystalline polyester resin dispersion liquid 1, 7,500 parts of the polyester resin D-1, 100 parts of the master batch 1, and 2 parts of the ketimine compound 1 as a curing agent were mixed with a TK HOMOMIXER (available from PRIMIX Corporation) at a revolution of 5,000 rpm for 60 minutes. Thus, an oil phase 1 was prepared.

Preparation of Fine Organic Particle Emulsion (Fine Particle Dispersion Liquid)

In a reaction vessel equipped with a stirrer and a thermometer, 683 parts of water, 11 parts of a sodium salt of a sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were contained and stirred at a revolution of 400 rpm for 15 minutes. Thus, a white emulsion was obtained. The white emulsion was heated to 75° C. and subjected to a reaction for 5 hours. A 1% aqueous solution of ammonium persulfate in an amount of 30 parts was further added to the emulsion, and the mixture was aged at 75° C. for 5 hours. Thus, a fine particle dispersion liquid 1 was prepared, that was an aqueous dispersion of a vinyl resin (i.e., a copolymer of styrene, methacrylic acid, and a sodium salt of a sulfate of ethylene oxide adduct of methacrylic acid).

The fine particles in the fine particle dispersion liquid 1 had a volume average particle diameter of 0.14 μm when measured by an instrument LA-920 (available from HORIBA, Ltd.). A part of the fine particle dispersion liquid 1 was dried to isolate the resin.

Preparation of Aqueous Phase

An aqueous phase 1 was prepared by stir-mixing 990 parts of water, 83 parts of the fine particle dispersion liquid 1, 37 parts of a 48.5% aqueous solution of sodium dodecyl diphenyl ether disulfonate (ELEMINOL MON-7 available from Sanyo Chemical Industries, Ltd.), and 90 parts of ethyl acetate. The aqueous phase 1 was a milky white liquid.

Emulsification and Solvent Removal

In the vessel containing the oil phase 1, 1,200 parts of the aqueous phase 1 was added and mixed with a TK HOMOMIXER at a revolution of 13,000 rpm for 20 minutes. Thus, an emulsion slurry 1 was prepared.

The emulsion slurry 1 was contained in a vessel equipped with a stirrer and a thermometer and subjected to solvent removal at 30° C. for 8 hours and subsequently to aging at 45° C. for 4 hours. Thus, a dispersion slurry 1 was obtained.

Washing and Drying

After 100 parts of the dispersion slurry 1 was filtered under reduced pressures, (1) 100 parts of ion-exchange water was added to the filter cake and mixed therewith using a TK HOMOMIXER at a revolution of 12,000 rpm for 10 minutes, followed by filtration; (2) 100 parts of a 10% aqueous solution of sodium hydroxide was added to the filter cake of (1) and mixed therewith using a TK HOMOMIXER at a revolution of 12,000 rpm for 30 minutes, followed by filtration under reduced pressures; (3) 100 parts of a 10% aqueous solution of hydrochloric was added to the filter cake of (2) and mixed therewith using a TK HOMOMIXER at a revolution of 12,000 rpm for 10 minutes, followed by filtration; and (4) 300 parts of ion-exchange water was added to the filter cake of (3) and mixed therewith using a TK HOMOMIXER at a revolution of 12,000 rpm for 10 minutes, followed by filtration. These operations (1) to (4) were repeated twice, thus obtaining a filter cake.

The filter cake was dried by a circulating air dryer at 45° C. for 48 hours and then filtered with a mesh having an opening of 75 μm. Thus, a mother toner particle 1 was prepared.

External Treatment Process

Next, 100 parts of the mother toner particle 1 was mixed with 0.6 parts by mass of a hydrophobic silica having an average particle diameter of 100 nm, 1.0 part by mass of a titanium oxide having an average particle diameter of 20 nm, and 0.8 parts by mass of a hydrophobic silica powder having an average particle diameter of 15 nm using a HENSCHEL MIXER. Thus, a toner 1 was obtained.

Preparation of Carrier

A resin layer coating liquid was prepared by dispersing 100 parts by mass of a silicone resin (organo straight silicone), 5 parts by mass of γ-(2-aminoethyl) aminopropyl trimethoxysilane, and 10 parts by mass of a carbon black in 100 parts by mass of toluene by a homomixer for 20 minutes. The resin layer coating liquid was applied to the surfaces of 1,000 parts of spherical magnetite having an average particle diameter of 50 μm by a fluidized bed coating device. Thus, a carrier was prepared.

Preparation of Developer

The toner 1 in an amount of 5 parts by mass and the carrier in an amount of 95 parts by mass were mixed. Thus, a developer was prepared. Next, various properties were evaluated with each of the prepared developers as follows. The results are presented in Table 1-1.

Low-Temperature Fixability

A copy test was performed by a copier IMAGIO MP C5002 (available from Ricoh Co., Ltd.) in which the fixing unit had been modified using a paper TYPE 6200 (available from Ricoh Co., Ltd.).

In the test, the cold offset temperature (lower-limit fixable temperature) and the high-temperature offset temperature (upper-limit fixable temperature) were determined by varying the fixing temperature.

The lower-limit fixable temperature was evaluated while setting the sheet feed linear velocity to 200 mm/sec, the surface pressure to 1.0 kgf/cm$^2$, and the nip width to 7 mm.

The upper-limit fixable temperature was evaluated while setting the sheet feed linear velocity to 100 mm/sec, the surface pressure to 1.0 kgf/cm$^2$, and the nip width to 7 mm.

When the lower-limit fixable temperature is lower than 140° C., low-temperature fixability is sufficient.

Evaluation Criteria

A: The lower-limit fixable temperature is lower than 130° C.

B: The lower-limit fixable temperature is 130° C. or higher and lower than 140° C.

C: The lower-limit fixable temperature is 140° C. or higher.

Heat-Resistant Storage Stability

A 50-ml glass vessel was filled with 10 g of each toner and left to stand in a thermostatic chamber at 50° C. for 24 hours and thereafter cooled to 24° C. The toner was then subjected to a penetration test according to JIS (Japanese Industrial Standards) K2235-1991 to measure a penetration. Heat-resistant storage stability was evaluated by the penetration based on the following criteria.

The greater the penetration, the better the heat-resistant storage stability.

Evaluation Criteria

A: Penetration is 30 mm or greater.

B: Penetration is 15 mm or greater and less than 30 mm.

C: Penetration is less than 15 mm.

Image Gloss

A copy test was performed by a copier IMAGIO MP C5002 (available from Ricoh Co., Ltd.) in which the fixing unit had been modified using a gloss paper POD GLOSS COAT 128 g/m$^2$ (available from Oji Paper Co., Ltd.).

In the test, a gloss value of an image fixed at a temperature of 140° C. was determined. The fixed image was subjected to a measurement of 60-degree gloss value with a gloss meter VG-7000 (available from NIPPON DENSHOKU INDUSTRIES CO., LTD.).

The fixing was preformed while setting the sheet feed linear velocity to 100 mm/sec, the surface pressure to 1.0 kgf/cm$^2$, and the nip width to 7 mm.

When the image gloss is 20% or higher, high gloss and high image quality are sufficiently achieved as an effect of the present invention.

Evaluation Criteria

A: Image gloss is 25% or higher and less than 50%.

B: Image gloss is 20% or higher and less than 25%, or 50% or higher and less than 60%.

C: Image gloss is less than 20% or 60% or higher.

Tg1st (toner) and T1/2 of the toner were also measured and the results are presented in Table 1-1.

Example 2

The procedure in Example 1 was repeated except for changing the amount of the prepolymer B from 900 parts to 300 parts, thus obtaining a mother toner particle 2 and a toner 2. The toner 2 was evaluated in the same manner as in Example 1. The results are presented in Table 1-1.

Example 3

The procedure in Example 1 was repeated except for changing the amount of the prepolymer B from 900 parts to 1,500 parts, thus obtaining a mother toner particle 3 and a toner 3. The toner 3 was evaluated in the same manner as in Example 1. The results are presented in Table 1-1.

Example 4

The procedure in Example 1 was repeated except for replacing the polyester resin D-1 with the polyester resin D-2, thus obtaining a mother toner particle 4 and a toner 4. The toner 4 was evaluated in the same manner as in Example 1. The results are presented in Table 1-1.

Example 5

The procedure in Example 1 was repeated except for replacing the polyester resin D-1 with the polyester resin D-3, thus obtaining a mother toner particle 5 and a toner 5. The toner 5 was evaluated in the same manner as in Example 1. The results are presented in Table 1-1.

Comparative Example 1

The procedure in Example 1 was repeated except for changing the amount of the prepolymer B to 0 part, thus obtaining a mother toner particle 6 and a toner 6. The toner 6 was evaluated in the same manner as in Example 1. The results are presented in Table 1-2.

Comparative Example 2

The procedure in Example 1 was repeated except for changing the amounts of the prepolymer A and the prepolymer B to 1,500 parts and 0 part, respectively, thus obtaining a mother toner particle 7 and a toner 7. The toner 7 was evaluated in the same manner as in Example 1. The results are presented in Table 1-2.

Comparative Example 3

The procedure in Example 1 was repeated except for changing the amount of the prepolymer A to 0 part, thus obtaining a mother toner particle 8 and a toner 8. The toner 8 was evaluated in the same manner as in Example 1. The results are presented in Table 1-2.

Comparative Example 4

Production Example A-2

Synthesis of Polyester Resin A-2

Synthesis of Prepolymer A-2

A reaction vessel equipped with a cooling tube, a stirrer, and a nitrogen introducing tube was charged with diol components comprising 100% by mol of 3-methyl-1,5-pentanediol, dicarboxylic acid components comprising 60% by mol of terephthalic acid and 40% by mol of adipic acid, and 1% by mol (based on all monomers) of trimethylolpropane, along with 1,000 ppm (based on the resin components) of titanium tetraisopropoxide, such that the molar ratio (OH/COOH) of hydroxyl groups to carboxyl groups became 1.5.

The vessel contents were heated to 200° C. over a period of about 4 hours, thereafter heated to 230° C. over a period of 2 hours, and the reaction was continued until outflow water was no more produced.

The vessel contents were further allowed to react under reduced pressures of from 10 to 15 mmHg for 5 hours. Thus, an intermediate polyester A-2 was prepared.

The intermediate polyester A-2 had a Tg of −30° C., an Mw of 10,000, and a ratio Mw/Mn of 2.5.

Next, in a reaction vessel equipped with a cooling tube, a stirrer, and a nitrogen introducing tube, the intermediate polyester A-2 and isophorone diisocyanate (IPDI) were contained such that the molar ratio of isocyanate groups in IPDT to hydroxyl groups in the intermediate polyester became 1.8. The vessel contents were diluted with ethyl acetate to become a 50% ethyl acetate solution and further allowed to react at 100° C. for 5 hours. Thus, a prepolymer A-2 was prepared.

Synthesis of Polyester Resin A-2

The above-prepared prepolymer A-2 was stirred in a reaction vessel equipped with a heater, a stirrer, and a nitrogen introducing tube. Furthermore, the ketimine compound 1 was dropped in the reaction vessel such that the amount of amine in the ketimine compound 1 became equimolar with the amount of isocyanate in the prepolymer A-2 and stirred at 45° C. for 10 hours. Thus, a prepolymer elongated product was obtained.

The prepolymer elongated product was dried at 50° C. under reduced pressures until the residual amount of ethyl acetate became 100 ppm or less. Thus, an amorphous polyester resin A-2 was prepared.

The amorphous polyester resin A-2 had a Tg of −20° C.

The amorphous polyester resin A-2 does not contain an isocyanurate backbone.

Comparative Example 4

The procedure in Example 1 was repeated except for replacing the polyester resin A-1 with the polyester resin A-2, thus obtaining a mother toner particle 9 and a toner 9. The toner 9 was evaluated in the same manner as in Example 1. The results are presented in Table 1-2.

Production Example B-2

Synthesis of Polyester Resin B-2

Synthesis of Amorphous Polyester Resin B-2

A polyester resin B-2 was obtained in the same manner as the polyester resin B except for replacing the trimellitic anhydride with pyromellitic anhydride. The amorphous polyester resin B-2 had a Tg of 48° C.

Comparative Example 5

The procedure in Example 1 was repeated except for replacing the polyester resin B-1 with the polyester resin B-2, thus obtaining a mother toner particle 10 and a toner 10. The toner 10 was evaluated in the same manner as in Example 1. The results are presented in Table 1-2.

TABLE 1-1

| | | Example 1 | Example 2 | Example 3 | Example 4 | Example 5 |
|---|---|---|---|---|---|---|
| | Toner | 1 | 2 | 3 | 4 | 5 |
| Composition Ratio (parts) | Amorphous Polyester Resin A-1 | 300 | 300 | 300 | 300 | 300 |
| | Amorphous Polyester Resin A-2 | 0 | 0 | 0 | 0 | 0 |
| | Amorphous Polyester Resin B-1 | 900 | 300 | 1500 | 900 | 900 |
| | Amorphous Polyester Resin B-2 | 0 | 0 | 0 | 0 | 0 |
| Other Polyester Resin | Type | D-1 | D-1 | D-1 | D-2 | D-3 |
| | Dicarboxylic Acids (molar ratio) | Terephthalic Acid 85/ Adipic Acid 15 | Terephthalic Acid 85/ Adipic Acid 15 | Terephthalic Acid 85/ Adipic Acid 15 | Terephthalic Acid 30/ Adipic Acid 70 | Terephthalic Acid 85/ Adipic Acid 15 |
| | Diols | BisA-EO 40/ BisA-PO 60 | BisA-EO 40/ BisA-PO 60 | BisA-EO 40/ BisA-PO 60 | BisA-EO 40/ BisA-PO 60 | BisA-EO 40/ BisA-PO 60 |
| | Tg | 58 | 58 | 58 | 45 | 70 |
| | Mw | 10000 | 10000 | 10000 | 18000 | 21000 |
| Measurement and Evaluation Results | Tg1st (toner) | 57 | 57 | 57 | 47 | 67 |
| | T½ | 115 | 103 | 130 | 115 | 115 |
| | Low-temperature Fixability | A | A | A | A | B |
| | Heat-resistant Storage Stability | A | B | A | B | A |
| | Image Gloss | A | B | B | A | A |

TABLE 1-2

| | | Comparative Example 1 | Comparative Example 2 | Comparative Example 3 | Comparative Example 4 | Comparative Example 5 |
|---|---|---|---|---|---|---|
| | Toner | 6 | 7 | 8 | 9 | 10 |
| Composition Ratio (parts) | Amorphous Polyester Resin A-1 | 300 | 1500 | 0 | 0 | 300 |
| | Amorphous Polyester Resin A-2 | 0 | 0 | 0 | 300 | 0 |

TABLE 1-2-continued

| | | Comparative Example 1 | Comparative Example 2 | Comparative Example 3 | Comparative Example 4 | Comparative Example 5 |
|---|---|---|---|---|---|---|
| | Amorphous Polyester Resin B-1 | 0 | 0 | 900 | 900 | 0 |
| | Amorphous Polyester Resin B-2 | 0 | 0 | 0 | 0 | 900 |
| Other Polyester Resin | Type | D-1 | D-1 | D-1 | D-1 | D-1 |
| | Dicarboxylic Acids (molar ratio) | Terephthalic Acid 85/ Adipic Acid 15 | Terephthalic Acid 85/ Adipic Acid 15 | Terephthalic Acid 85/ Adipic Acid 15 | Terephthalic Acid 85/ Adipic Acid 15 | Terephthalic Acid 85/ Adipic Acid 15 |
| | Diols | BisA-EO 40/ BisA-PO 60 | BisA-EO 40/ BisA-PO 60 | BisA-EO 40/ BisA-PO 60 | BisA-EO 40/ BisA-PO 60 | BisA-EO 40/ BisA-PO 60 |
| | Tg | 58 | 58 | 58 | 58 | 58 |
| | Mw | 10000 | 10000 | 10000 | 10000 | 10000 |
| Measurement and Evaluation Results | Tg1st (toner) | 57 | 42 | 62 | 58 | 58 |
| | T½ | 100 | 115 | 110 | 122 | 123 |
| | Low-temperature Fixability | A | A | C | C | C |
| | Heat-resistant Storage Stability | B | C | A | B | B |
| | Image Gloss | C | A | A | B | B |

It is confirmed from the results presented in Tables 1-1 and 1-2 that the toners of Examples 1 to 5 have excellent low-temperature fixability, gloss, and heat-resistant storage stability, where each of which comprises a crystalline polyester resin, an amorphous polyester resin A comprising an isocyanurate backbone and urethane bond and/or urea bond, and an amorphous polyester resin B comprising a trimellitic acid backbone and urethane bond and/or urea bond as binder resins.

By contrast, the toners of Comparative Examples 1 and 2 have poor image gloss and heat-resistant storage stability because of the absence of the amorphous polyester resin B.

The toner of Comparative Example 3 has poor low-temperature fixability because of absence of the amorphous polyester resin A.

The toner of Comparative Example 4 has poor low-temperature fixability because of the absence of an isocyanurate backbone in the amorphous polyester resin A-2.

The toner of Comparative Example 5 has poor low-temperature fixability because of the absence of a trimellitic acid backbone in the amorphous polyester resin B-2.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

a colorant;

a release agent; and a binder resin comprising:

a crystalline polyester resin; and an amorphous polyester resin comprising:

an amorphous polyester resin A comprising an isocyanurate backbone and at least one of urethane bond and urea bond; and an amorphous polyester resin B comprising a trimellitic acid backbone and at least one of urethane bond and urea bond, wherein a glass transition temperature of the amorphous polyester resin B is 30° C. or higher and lower than 70° C., a content of the crystalline polyester resin is from 3 to 20 parts based on 100 parts of the toner, a content of the amorphous polyester resin A is from 1 to 10 parts based on 100 parts of the toner, a content of the amorphous polyester resin B is from 3 to 15 parts based on 100 parts of the toner, and a ratio of polyester resin A to polyester resin B is from 1/1 to 1/5.

2. The toner of claim 1, wherein the amorphous polyester resin A comprises a structure selected from the group consisting of structural formulae 1) to 3):

$$R1\text{-}(NHCONH—R2)_n\text{-}; \quad 1)$$

$$R1\text{-}(NHCOO—R2)_n\text{-}; \text{ and} \quad 2)$$

$$R1\text{-}(OCONH—R2)_n\text{-}, \quad 3)$$

wherein n represents an integer of 3,

R1 represents an isocyanurate backbone, and

R2 represents a group derived from a polyester comprising a polycarboxylic acid and a polyol or from an isocyanate-modified polyester.

3. The toner of claim 1, wherein a parameter T1/2 of the toner is from 105° C. to 125° C., wherein the parameter T1/2 is measured according to a temperature rising method by a flow tester.

4. The toner of claim 1, wherein a glass transition temperature (Tg1st (toner)) of the toner is from 50° C. to 65° C., wherein the Tg1st (toner) is determined from an endothermic curve obtained in a first temperature rising in a measurement by a differential scanning calorimeter.

5. A toner storage unit comprising:

a container; and the toner of claim 1 stored in the container.

6. An image forming apparatus comprising:

an electrostatic latent image bearer;

an electrostatic latent image forming device configured to form an electrostatic latent image on the electrostatic latent image bearer; and a developing device containing the toner of claim 1, configured to develop the electrostatic latent image formed on the electrostatic latent image bearer with the toner to form a visible image.

7. An image forming method comprising:

charging an electrostatic latent image bearer;

forming an electrostatic latent image on the charged electrostatic latent image bearer;

developing the electrostatic latent image bearer into a toner image with the toner of claim 1;

primarily transferring the toner image formed on the electrostatic latent image bearer onto an intermediate transfer medium;

secondarily transferring the toner image transferred onto the intermediate transfer medium onto a recording medium;

fixing the toner image on the intermediate transfer medium by application of heat and pressure; and removing residual toner particles remaining on the electrostatic latent image bearer after the toner image has been transferred onto the intermediate transfer medium.

8. The image forming method of claim 7, wherein, in the secondarily transferring, the toner imager is transferred onto the recording medium at a linear velocity of from 100 to 1,000 mm/sec and a transfer time of from 0.5 to 60 msec.

* * * * *